US007910225B2

(12) United States Patent
Taylor

(10) Patent No.: US 7,910,225 B2
(45) Date of Patent: Mar. 22, 2011

(54) LOW THERMAL EXPANSION BONDCOATS FOR THERMAL BARRIER COATINGS

(75) Inventor: Thomas A. Taylor, Indianapolis, IN (US)

(73) Assignee: Praxair S.T. Technology, Inc., North Haven, CT (US)

( * ) Notice: Subject to any disclaimer, the term of this patent is extended or adjusted under 35 U.S.C. 154(b) by 1079 days.

(21) Appl. No.: 11/703,361

(22) Filed: Feb. 7, 2007

(65) Prior Publication Data

US 2008/0032105 A1 Feb. 7, 2008

Related U.S. Application Data

(60) Provisional application No. 60/772,524, filed on Feb. 13, 2006.

(51) Int. Cl.
*B32B 15/04* (2006.01)
*B32B 15/18* (2006.01)

(52) U.S. Cl. ..... 428/679; 428/678; 428/215; 416/241 R

(58) Field of Classification Search ..... None
See application file for complete search history.

(56) References Cited

U.S. PATENT DOCUMENTS

| | | | | |
|---|---|---|---|---|
| 3,754,903 | A | 8/1973 | Goward et al. | |
| 3,785,877 | A | 1/1974 | Bailey | |
| 5,073,433 | A | 12/1991 | Taylor | |
| 5,455,119 | A | 10/1995 | Taylor et al. | |
| 5,741,556 | A | 4/1998 | Taylor et al. | |
| 5,863,668 | A | 1/1999 | Brindley et al. | |
| 5,981,091 | A | 11/1999 | Rickerby et al. | |
| 6,093,454 | A | 7/2000 | Brindley et al. | |
| 6,610,419 | B1 * | 8/2003 | Stamm | 428/632 |
| 6,703,137 | B2 * | 3/2004 | Subramanian | 428/469 |
| 6,838,190 | B2 | 1/2005 | Lee et al. | |
| 2007/0187005 | A1 * | 8/2007 | Taylor | 148/428 |
| 2007/0190354 | A1 * | 8/2007 | Taylor | 428/678 |
| 2008/0199684 | A1 * | 8/2008 | Apte et al. | 428/328 |
| 2008/0199722 | A1 * | 8/2008 | Apte et al. | 428/633 |

FOREIGN PATENT DOCUMENTS

JP 61106763 A 5/1986

OTHER PUBLICATIONS

T.A. Taylor, et al., "Thermal expansion of MCrAlY alloys", Surface & Coatings Technology 177-178 (2004) 24-31.

Thomas A. Taylor, "Dilatometer Studies of NiCrAlY Coatings", International Conference on Metallurgical Coatings and Thin Films Apr. 19-23, 2004.

* cited by examiner

*Primary Examiner* — Aaron Austin
(74) *Attorney, Agent, or Firm* — Robert J. Hampsch

(57) ABSTRACT

This invention relates to low thermal expansion bondcoats for thermal barrier coatings. The bondcoats comprise: (i) an inner layer comprising an inner layer alloy of MCrAlM', and (ii) an outer layer comprising an outer layer alloy of MCrAlM', wherein M is an element selected from nickel, cobalt, iron and mixtures thereof, and M' is an element selected from yttrium, zirconium, hafnium, ytterbium and mixtures thereof. The inner layer alloy is thermally sprayed from a powder having a mean particle size of 50 percentile point in distribution of from about 5 microns to about 50 microns. The outer layer alloy is thermally sprayed from a powder having a mean particle size of 50 percentile point in distribution of from about 30 microns to about 100 microns. The bondcoat has a thermal expansion of about 6.5 millimeters per meter or less between a temperature of from about 25° C. to about 525° C.

25 Claims, 8 Drawing Sheets

LOW THERMAL EXPANSION BONDCOATS FOR THERMAL BARRIER COATINGS

RELATED APPLICATIONS

This application claims the benefit of U.S. Provisional Application Ser. No. 60/772,524, filed on Feb. 13, 2006, which is incorporated herein by reference.

FIELD OF THE INVENTION

This invention relates to low thermal expansion bondcoats for thermal barrier coatings, thermal barrier coatings comprising said bondcoats, methods for minimizing or eliminating interface stress and crack formation in a ceramic insulating layer of a thermal barrier coating, alloy powders suitable for thermal spraying or other cladding methods, and coating compositions suitable for thermal spraying or other cladding methods.

BACKGROUND OF THE INVENTION

Thermal barrier coatings have become essential for hot section components in aero and IGT turbine engines, to allow them to run at todays' high temperatures. The thermal barrier coating is considered a system, comprised of the superalloy substrate alloy, a metallic bondcoat and a zirconia-based outer ceramic layer. The zirconia ceramic has relatively low thermal conductivity and thus provides thermal insulation to the substrate. In the engine, the thermal barrier coating system is operated in a temperature gradient, with the zirconia surface exposed to the hot gas side of the turbine section and the substrate alloy of the blade, vane or combustor component typically air cooled on the back side.

Thermal expansion mismatch between the metal and ceramic layers of the thermal barrier coating will provide a varying stress in the layers as the system is thermally cycled in service. The thermal expansion of typical superalloys are only about 6 percent less than an MCrAlY bondcoat like LCO-22 (Co-32Ni-21Cr-8Al-0.5Y), and thermal stresses between them is likely to be partially relieved by plasticity. See, for example, Alloy Reference List, United Technologies Pratt and Whitney, October 1986 and T. A. Taylor and P. N. Walsh, ICMCTF Conference, San Diego, Apr. 28, 2003. The interface of concern is between the bondcoat and the typical zirconia ceramic. At 525° C. the thermal expansion from room temperature [T. A. Taylor and P. N. Walsh, supra] for these two materials are (mm/m):

| LCO-22 | ZrO2—7% Y2O3 | Difference (%) |
|---|---|---|
| 7.51 | 5.3 | 42 |

The difference in expansion, relative to the zirconia layer is about 42 percent, and this could lead to substantial interface stress, possibly crack formation in the ceramic, if not relieved by bondcoat relaxation through creep. For fast thermal cycling, this stress may not be so relieved. Since the thermal expansion of 7% yttria stabilized zirconia is already high for a ceramic material, a search for lower expansion MCrAlY bondcoats is desirable for minimizing this inter-layer stress and perhaps leading to longer thermal barrier coating thermal cycle life. It would therefore be desirable in the art to provide lower expansion MCrAlY bondcoats for minimizing inter-layer stress that lead to longer thermal barrier coating thermal cycle life.

SUMMARY OF THE INVENTION

This invention relates to a low thermal expansion bondcoat for thermal barrier coatings, said bondcoat comprising: (i) an inner layer comprising an inner layer alloy of MCrAlM' wherein M is an element selected from nickel, cobalt, iron and mixtures thereof, and M' is an element selected from yttrium, zirconium, hafnium, ytterbium and mixtures thereof, and wherein M comprises from about 35 to about 80 weight percent of said inner layer alloy, Cr comprises from about 15 to about 45 weight percent of said inner layer alloy, Al comprises from about 5 to about 30 weight percent of said inner layer alloy, and M' comprises from about 0.01 to about 1.0 weight percent of said inner layer alloy, said inner layer alloy thermally sprayed from a powder having a mean particle size of 50 percentile point in distribution of from about 5 microns to about 50 microns; and (ii) an outer layer comprising an outer layer alloy of MCrAlM' wherein M is an element selected from nickel, cobalt, iron and mixtures thereof, and M' is an element selected from yttrium, zirconium, hafnium, ytterbium and mixtures thereof, and wherein M comprises from about 35 to about 80 weight percent of said outer layer alloy, Cr comprises from about 15 to about 45 weight percent of said outer layer alloy, Al comprises from about 5 to about 30 weight percent of said outer layer alloy, and M' comprises from about 0.01 to about 1.0 weight percent of said outer layer alloy, said outer layer alloy thermally sprayed from a powder having a mean particle size of 50 percentile point in distribution of from about 30 microns to about 100 microns, and said outer layer having a surface roughness of at least 200 micro-inches; and wherein said bondcoat has a thermal expansion of about 6.5 millimeters per meter or less between a temperature of from about 25° C. to about 525° C.

This invention also relates to a thermal barrier coating for a metal or non-metal substrate comprising (a) a low thermal expansion bondcoat layer applied to said substrate, said bondcoat layer comprising: (i) an inner layer comprising an inner layer alloy of MCrAlM' wherein M is an element selected from nickel, cobalt, iron and mixtures thereof, and M' is an element selected from yttrium, zirconium, hafnium, ytterbium and mixtures thereof, and wherein M comprises from about 35 to about 80 weight percent of said inner layer alloy, Cr comprises from about 15 to about 45 weight percent of said inner layer alloy, Al comprises from about 5 to about 30 weight percent of said inner layer alloy, and M' comprises from about 0.01 to about 1.0 weight percent of said inner layer alloy, said inner layer alloy thermally sprayed from a powder having a mean particle size of 50 percentile point in distribution of from about 5 microns to about 50 microns; and (ii) an outer layer comprising an outer layer alloy of MCrAlM' wherein M is an element selected from nickel, cobalt, iron and mixtures thereof, and M' is an element selected from yttrium, zirconium, hafnium, ytterbium and mixtures thereof, and wherein M comprises from about 35 to about 80 weight percent of said outer layer alloy, Cr comprises from about 15 to about 45 weight percent of said outer layer alloy, Al comprises from about 5 to about 30 weight percent of said outer layer alloy, and M' comprises from about 0.01 to about 1.0 weight percent of said outer layer alloy, said outer layer alloy thermally sprayed from a powder having a mean particle size of 50 percentile point in distribution of from about 30 microns to about 100 microns, and said outer layer having a surface roughness of at least 200 micro-inches; and wherein said bondcoat has a thermal expansion of about 6.5 millimeters per meter or less between a temperature of from about 25° C. to about 525° C., and (b) a ceramic insulating layer applied to said bondcoat layer.

This invention further relates to a method for minimizing or eliminating interface stress and crack formation in a ceramic insulating layer of a thermal barrier coating, said method comprising (a) applying a low thermal expansion bondcoat layer to a metal or non-metal substrate, said bondcoat layer comprising: (i) an inner layer comprising an inner layer alloy of MCrAlM' wherein M is an element selected from nickel, cobalt, iron and mixtures thereof, and M' is an element selected from yttrium, zirconium, hafnium, ytterbium and mixtures thereof, and wherein M comprises from about 35 to about 80 weight percent of said inner layer alloy, Cr comprises from about 15 to about 45 weight percent of said inner layer alloy, Al comprises from about 5 to about 30 weight percent of said inner layer alloy, and M' comprises from about 0.01 to about 1.0 weight percent of said inner layer alloy, said inner layer alloy thermally sprayed from a powder having a mean particle size of 50 percentile point in distribution of from about 5 microns to about 50 microns; and (ii) an outer layer comprising an outer layer alloy of MCrAlM' wherein M is an element selected from nickel, cobalt, iron and mixtures thereof, and M' is an element selected from yttrium, zirconium, hafnium, ytterbium and mixtures thereof, and wherein M comprises from about 35 to about 80 weight percent of said outer layer alloy, Cr comprises from about 15 to about 45 weight percent of said outer layer alloy, Al comprises from about 5 to about 30 weight percent of said outer layer alloy, and M' comprises from about 0.01 to about 1.0 weight percent of said outer layer alloy, said outer layer alloy thermally sprayed from a powder having a mean particle size of 50 percentile point in distribution of from about 30 microns to about 100 microns, and said outer layer having a surface roughness of at least 200 micro-inches; and wherein said bondcoat has a thermal expansion of about 6.5 millimeters per meter or less between a temperature of from about 25° C. to about 525° C., and (b) applying said ceramic insulating layer to said bondcoat layer.

The invention has several advantages. For example, the low thermal expansion of the bondcoats of this invention minimizes or eliminates interface stress and crack formation in the ceramic layer and therefore leads to longer thermal barrier coating cycle life. There are many applications where a cast or wrought alloy having lower thermal expansion would allow an article to have superior performance. Articles fabricated from the alloy powders of this invention, e.g., cast or wrought alloy articles, may exhibit good high temperature oxidation resistance, even better than typical Ni-based superalloys or stainless steels, due to the high Cr and Al content of the alloy powders of this invention.

DETAILED DESCRIPTION OF THE INVENTION

Figure 1:
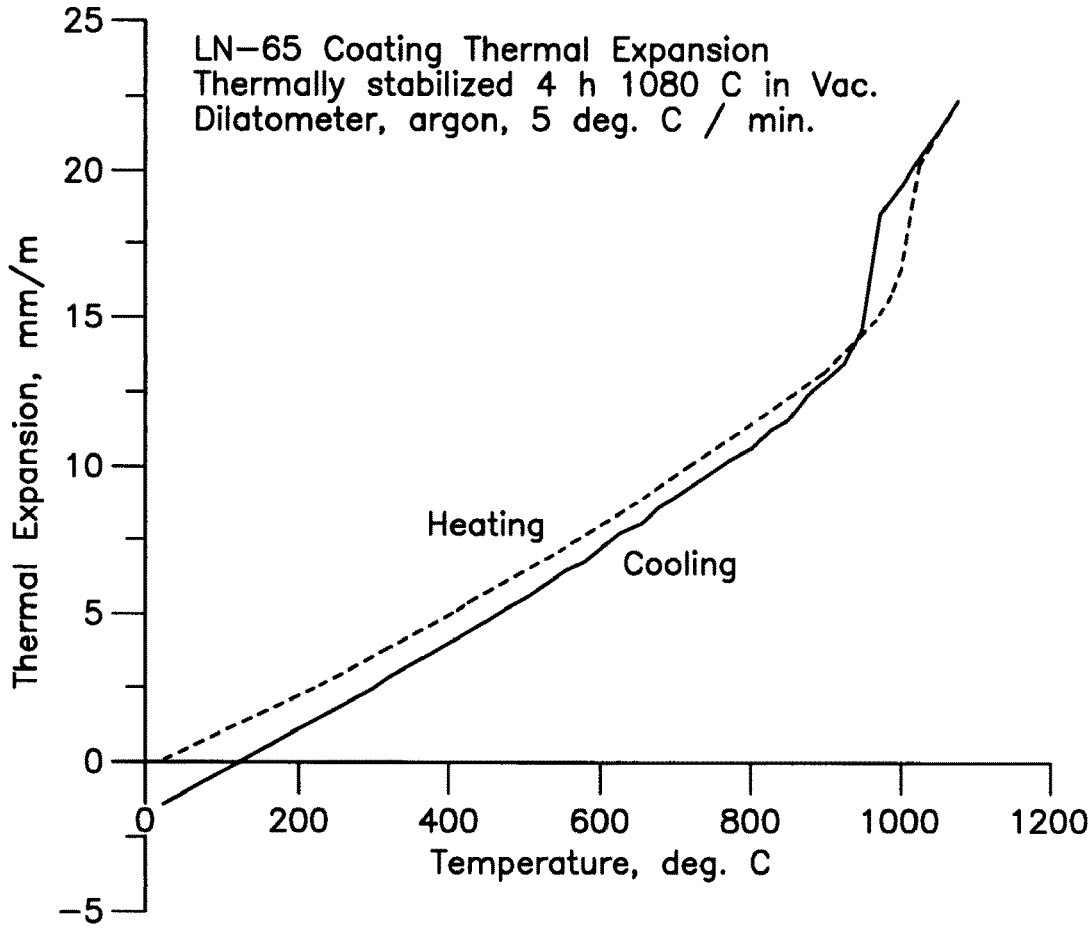
FIG. 1 depicts a graph of thermal expansion from room temperature to 1075° C. for NiCrAlY coating LN-65 (pre-stabilized 4 hours/1080° C./vacuum. dilatometer, argon, 5° C./min.) showing upsweep in expansion near 950° C., hysteresis of this effect on cooling, and slight (0.15%) additional shrinkage.

Alloy powders suitable for use in this invention can be coarse or fine and comprise an alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy powder having a mean particle size of 50 percentile point in distribution of from about 5 microns to about 100 microns. In an embodiment, the coarse alloy powder has a mean particle size of 50 percentile point in distribution of from about 30 microns to about 100 microns. In another embodiment, the fine alloy powder has a mean particle size of 50 percentile point in distribution of from about 5 microns to about 50 microns.

Preferred alloy powders include those where M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The coarse alloy powders preferably have a mean particle size of 50 percentile point in distribution of from about 40 microns to about 85 microns, more preferably a mean particle size of 50 percentile point in distribution of from about 50 microns to about 60 microns. The fine alloy powders preferably have a mean particle size of 50 percentile point in distribution of from about 10 microns to about 40 microns, more preferably a mean particle size of 50 percentile point in distribution of from about 18 microns to about 25 microns.

An alpha-Cr phase is present in the alloys up to a temperature of at least about 1000° C. Preferably, the alpha-Cr phase is present in an amount sufficient to control thermal expansion of the alloys to about 6.5 mm/m or less between a temperature of from about 25° C. to about 525° C. The alloys may be heat treated to stabilize their equilibrium phases. An alpha-Cr phase is preferably in equilibrium in a thermally stabilized coating comprising the alloys at a temperature of about 800° C. and the alpha-Cr phase does not dissolve upon heating to a temperature of at least about 1000° C. The alloys fall within the gamma-beta-alpha-Cr region of a phase diagram, for example, an alpha-Cr+beta-NiAl+gamma (FCC Ni alloy) phase field, at a temperature of about 1150° C.

The alloys may be prepared by conventional methods such as described in Superalloys II, eds. Sims, Stoloff and Hagel, John Wiley (1987), p. 387-458. The alloy powders useful in this invention may be prepared by conventional methods such as described in U.S. Pat. Nos. 5,455,119 and 5,741,556, the disclosures of which are incorporated herein by reference.

Articles can be produced from the alloys above, e.g., cast or wrought alloy articles, and coatings can be made from the powders. The powders suitable for thermal spraying or other cladding methods made from the alloys above may include up to about 10 volume percent stable oxide particles. e.g., yttria, hafnia or alumina. For certain coatings made from the powders above, during deposition of the coating, oxygen and/or carbon are intentionally added to the coating.

The above alloy powders suitable for thermal spraying or other cladding methods and other related subject matter above are disclosed and claimed in copending U.S. patent application Ser. No. 11/703,360, filed on an even date herewith, which is incorporated herein by reference.

Coating compositions suitable for use in this invention comprise an alloy powder of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy powder having a mean particle size of 50 percentile point in distribution of from about 5 microns to about 100 microns. The coarse alloy powders have a mean particle size of 50 percentile point in distribution of from about 30 microns to about 100 microns, and the fine alloy powders have a mean particle size of 50 percentile point in distribution of from about 5 microns to about 50 microns.

Preferred coating compositions include alloy powders where M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The coarse alloy powders preferably have a mean particle size of 50 percentile point in distribution of from about 40 microns to about 85 microns, and more preferably a mean particle size of 50 percentile point in distribution of from about 50 microns to about 60 microns. The fine alloy powders preferably have a mean particle size of 50 percentile point in distribution of from about 10 microns to about 40 microns, and more preferably a mean particle size of 50 percentile point in distribution of from about 18 microns to about 25 microns.

An alpha-Cr phase is present in the alloys up to a temperature of at least about 1000° C. Preferably, the alpha-Cr phase is present in an amount sufficient to control thermal expansion of the alloys to about 6.5 mm/m or less between a temperature of from about 25° C. to about 525° C. The alloys may be heat treated to stabilize their equilibrium phases. An alpha-Cr phase is preferably in equilibrium in a thermally stabilized coating comprising the alloys at a temperature of about 800° C. and the alpha-Cr phase does not dissolve upon heating to a temperature of at least about 1000° C. The alloys fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the coating compositions. The oxide dispersion may be selected from alumina, thoria, yttria and rare earth oxides, hafnia and zirconia. The oxide dispersion may comprise from about 5 to about 25 volume percent of the coating composition.

The coating compositions useful in this invention may be prepared by conventional methods such as described in Superalloys II, p. 459-494 (powder making) and ASM Handbook, Vol. 5, Surface Engineering 1994, p. 497-509 (thermal spray coatings).

Articles can be produced from the coating compositions above and coatings can be made from the powders. The powders suitable for thermal spraying or other cladding methods made from the alloys above may include up to about 10 volume percent stable oxide particles. e.g., yttria, hafnia or alumina. For certain coatings made from the powders above, during deposition of the coating, oxygen and/or carbon are intentionally added to the coating.

The above coating compositions suitable for thermal spraying or other cladding methods and other related subject matter above are disclosed and claimed in copending U.S. patent application Ser. No. 11/703,360, filed on an even date herewith, which is incorporated herein by reference.

The bondcoat comprises two metallic layers, both of the same or different low expansion alloy composition. An inner layer bondcoat may be made using fine powder for the thermal spray that is dense and protective to the substrate from oxidation. An outer layer bondcoat may be made from coarser powder to provide a rougher surface for the subsequent attachment of the ceramic insulating layer.

As indicated above, this invention relates to low thermal expansion bondcoats for thermal barrier coatings, said bondcoat comprising: (i) an inner layer comprising an inner layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said inner layer alloy, Cr comprises from about 15 to about 45 weight percent of said inner layer alloy, Al comprises from about 5 to about 30 weight percent of said inner layer alloy, and M' comprises from about 0.01 to about 1.0 weight percent of said inner layer alloy, said inner layer alloy thermally sprayed from a powder having a mean particle size of 50 percentile point in distribution of from about 5 microns to about 50 microns; and (ii) an outer layer comprising an outer layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said outer layer alloy, Cr comprises from about 15 to about 45 weight percent of said outer layer alloy, Al comprises from about 5 to about 30 weight percent of said outer layer alloy, and M' comprises from about 0.01 to about 1.0 weight percent of said outer layer alloy, said outer layer alloy thermally sprayed from a powder having a mean particle size of 50 percentile point in distribution of from about 30 microns to about 100 microns, and said outer layer having a surface roughness of at least 200 micro-inches; and wherein said bondcoat has a thermal expansion of about 6.5 millimeters per meter or less between a temperature of from about 25° C. to about 525° C. The inner layer alloy and the outer layer alloy may be of the same or different composition.

Preferred inner layer bondcoats include those wherein, in the composition of the inner layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 10 microns to about 40 microns, more preferably a mean particle size of 50 percentile point in distribution of from about 18 microns to about 25 microns.

Preferred outer layer bondcoats include those wherein, in the composition of the outer layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 40 microns to about 85 microns, more preferably a mean particle size of 50 percentile point in distribution of from about 50 microns to about 60 microns.

The outer layer bondcoats preferably have a surface roughness of at least 225 micro-inches, more preferably a surface roughness of at least 250 micro-inches. The low thermal expansion bondcoats preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C.

The inner layer bondcoats typically have a thickness of from about 4 to about 320 mils, preferably a thickness of from about 40 to about 240 mils, and more preferably a thickness of from about 80 to about 160 mils. The outer layer bondcoats typically have a thickness of from about 4 to about 480 mils, preferably a thickness of from about 80 to about 400 mils, and more preferably a thickness of from about 160 to about 240 mils.

An alpha-Cr phase is present in the bondcoats of this invention up to a temperature of at least about 1000° C. Preferably, the alpha-Cr phase is present in an amount sufficient to control thermal expansion of the bondcoats to about 6.5 mm/m or less between a temperature of from about 25° C. to about 525° C. The bondcoats of this invention may be heat treated to stabilize their equilibrium phases. An alpha-Cr phase is preferably in equilibrium in thermally stabilized bondcoats of this invention at a temperature of about 800° C. and the alpha-Cr phase does not dissolve upon heating to a temperature of at least about 1000° C. The bondcoats of this invention fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoats of this invention. The oxide dispersion may be selected from alumina, thoria, yttria and rare earth oxides, hafnia and zirconia. The oxide dispersion may comprise from about 5 to about 25 volume percent of the bondcoat composition. This invention also relates to articles produced from the bondcoats above.

The inner layer bondcoats can be deposited onto a metal or non-metal substrate and the outer layer bondcoats can be deposited onto the inner layer bondcoats using any thermal spray device by conventional methods. Preferred thermal spray methods for depositing the bondcoats are inert gas shrouded plasma spraying, low pressure or vacuum plasma spraying in chambers, high velocity oxygen-fuel torch spraying, detonation gun coating and the like. The most preferred method is inert gas shrouded plasma spraying. It could also be advantageous to heat treat the bondcoats using appropriate times and temperatures to achieve a good bond for the bondcoats to the substrate and a high sintered density of the bondcoats. Other means of applying a uniform deposit of powder to a substrate in addition to thermal spraying include, for example, electrophoresis, electroplating and slurry deposition.

The low thermal expansion bondcoats for thermal barrier coatings can comprise an alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy thermally sprayed from a powder having a mean particle size of 50 percentile point in distribution of from about 5 microns to about 100 microns, said bondcoat having a surface roughness of at least 200 micro-inches, and said bondcoat having a thermal expansion of about 6.5 millimeters per meter or less between a temperature of from about 25° C. to about 525° C.

Preferred bondcoats include those wherein, in the composition of the alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. In one embodiment, the alloy is sprayed from a coarse powder having a mean particle size of 50 percentile point in distribution of from about 30 microns to about 100 microns, preferably a mean particle size of 50 percentile point in distribution of from about 40 microns to about 85 microns, and more preferably a mean particle size of 50 percentile point in distribution of from about 50 microns to about 60 microns. In another embodiment, the alloy is sprayed from a fine powder having a mean particle size of 50 percentile point in distribution of from about 5 microns to about 50 microns, preferably a mean particle size of 50 percentile point in distribution of from about 10 microns to about 40 microns, and more preferably a mean particle size of 50 percentile point in distribution of from about 18 microns to about 25 microns.

The low thermal expansion bondcoats preferably have a surface roughness of at least 225 micro-inches, more preferably a surface roughness of at least 250 micro-inches. The bondcoats preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C. The bondcoats typically have a thickness of from about 4 to about 480 mils, preferably a thickness of from about 80 to about 400 mils.

An alpha-Cr phase is present in the bondcoats up to a temperature of at least about 1000° C. Preferably, the alpha-Cr phase is present in an amount sufficient to control thermal expansion of the bondcoats to about 6.5 mm/m or less between a temperature of from about 25° C. to about 525° C. The bondcoats may be heat treated to stabilize their equilibrium phases. An alpha-Cr phase is preferably in equilibrium in thermally stabilized bondcoats at a temperature of about 800° C. and the alpha-Cr phase does not dissolve upon heating to a temperature of at least about 1000° C. The bondcoats fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoats. The oxide dispersion may be selected from alumina, thoria, yttria and rare earth oxides, hafnia and zirconia. The oxide dispersion may comprise from about 5 to about 25 volume percent of the bondcoat. Articles can be produced from the bondcoats above.

The low thermal expansion bondcoats can be deposited onto a metal or non-metal substrate using any thermal spray device by conventional methods. Preferred thermal spray methods for depositing the bondcoat are inert gas shrouded plasma spraying, low pressure or vacuum plasma spraying in chambers, high velocity oxygen-fuel torch spraying, detonation gun coating and the like. The most preferred method is inert gas shrouded plasma spraying. It could also be advantageous to heat treat the bondcoat using appropriate times and temperatures to achieve a good bond for the bondcoat to the substrate and a high sintered density of the bondcoat. Other means of applying a uniform deposit of powder to a substrate in addition to thermal spraying include, for example, electrophoresis, electroplating and slurry deposition.

The above low thermal expansion bondcoats for thermal barrier coatings and other related subject matter above are disclosed and claimed in copending U.S. patent application Ser. No. 11/703,339, filed on an even date herewith, which is incorporated herein by reference.

As indicated above, this invention relates to thermal barrier coatings for a metal or non-metal substrate comprising (a) a low thermal expansion bondcoat layer applied to said substrate, said bondcoat layer comprising: (i) an inner layer comprising an inner layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said inner layer alloy, Cr comprises from about 15 to about 45 weight percent of said inner layer alloy, Al comprises from about 5 to about 30 weight percent of said inner layer alloy, and M' comprises from about 0.01 to about 1.0 weight percent of said inner layer alloy, said inner layer alloy thermally sprayed from a powder having a mean particle size of 50 percentile point in distribution of from about 5 microns to about 50 microns; and (ii) an outer layer comprising an outer layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said outer layer alloy, Cr comprises from about 15 to about 45 weight percent of said outer layer alloy, Al comprises from about 5 to about 30 weight percent of said outer layer alloy, and M' comprises from about 0.01 to about 1.0 weight percent of said outer layer alloy, said outer layer alloy thermally sprayed from a powder having a mean particle size of 50 percentile point in distribution of from about 30 microns to about 100 microns, and said outer layer having a surface roughness of at least 200 micro-inches; and wherein said bondcoat has a thermal expansion of about 6.5 millimeters per meter or less between a temperature of from about 25° C. to about 525° C., and (b) a ceramic insulating layer applied to said bondcoat layer. The inner layer alloy and the outer layer alloy may be of the same or different composition.

Preferred inner layer bondcoats include those wherein, in the composition of the inner layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 10 microns to about 40 microns, more preferably a mean particle size of 50 percentile point in distribution of from about 18 microns to about 25 microns.

Preferred outer layer bondcoats include those wherein, in the composition of the outer layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 40 microns to about 85 microns, more preferably a mean particle size of 50 percentile point in distribution of from about 50 microns to about 60 microns.

The outer layer bondcoats preferably have a surface roughness of at least 225 micro-inches, more preferably a surface roughness of at least 250 micro-inches. The low thermal expansion bondcoats preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C.

The inner layer bondcoats typically have a thickness of from about 4 to about 320 mils, preferably a thickness of from about 40 to about 240 mils, and more preferably a thickness of from about 80 to about 160 mils. The outer layer bondcoats typically have a thickness of from about 4 to about 480 mils, preferably a thickness of from about 80 to about 400 mils, and more preferably a thickness of from about 160 to about 240 mils.

An alpha-Cr phase is present in the bondcoats of this invention up to a temperature of at least about 1000° C. Preferably, the alpha-Cr phase is present in an amount sufficient to control thermal expansion of the bondcoats to about 6.5 mm/m or less between a temperature of from about 25° C. to about 525° C. The bondcoats of this invention may be heat treated to stabilize their equilibrium phases. An alpha-Cr phase is preferably in equilibrium in thermally stabilized bondcoats of this invention at a temperature of about 800° C. and the alpha-Cr phase does not dissolve upon heating to a temperature of at least about 1000° C. The bondcoats of this invention fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoats of this invention. The oxide dispersion may be selected from alumina, thoria, yttria and rare earth oxides, hafnia and zirconia. The oxide dispersion may comprise from about 5 to about 25 volume percent of the bondcoat composition. This invention also relates to articles produced from the thermal barrier coatings above.

Ceramic insulating layers that can be applied to the bondcoat layer to form a thermal barrier coating are known in the art. Illustrative ceramic insulating layers comprise zirconium oxide and yttrium oxide. Preferred ceramic insulating layers include zirconia partially or fully stabilized by yttria and having a density greater than 88% of the theoretical density with a plurality of vertical macrocracks homogeneously dispersed throughout the ceramic insulating layer to improve its thermal fatigue resistance. See, for example, U.S. Pat. No. 5,073,433, the disclosure of which is incorporated herein by reference. Other ceramic insulating layers useful in this invention include zirconia partially or fully stabilized by yttria and having a density from about 60% to 85% of the theoretical density, e.g., low density zirconia partially or fully stabilized by yttria.

Some suitable metal substrates include, for example, nickel base superalloys, nickel base superalloys containing titanium, cobalt base superalloys, and cobalt base superalloys containing titanium. Preferably, the nickel base superalloys would contain more than 50% by weight nickel and the cobalt base superalloys would contain more than 50% by weight cobalt. Illustrative non-metal substrates include, for example, permissible silicon-containing materials.

The low thermal expansion bondcoat layer can be deposited onto a metal or non-metal substrate, and the ceramic insulating layer can be deposited onto the bondcoat layer, using any thermal spray device by conventional methods. Preferred thermal spray methods for depositing the bondcoat layer and ceramic insulating layer are inert gas shrouded plasma spraying, low pressure or vacuum plasma spraying in chambers, high velocity oxygen-fuel torch spraying, detonation gun coating and the like. The most preferred method is inert gas shrouded plasma spraying. It could also be advantageous to heat treat the bondcoats using appropriate times and temperatures to achieve a good bond for the bondcoats to the substrate and a high sintered density of the bondcoats. Other means of applying a uniform deposit of powder to a substrate in addition to thermal spraying include, for example, electrophoresis, electroplating and slurry deposition.

The thermal barrier coatings for a metal or non-metal substrate can comprise (i) a low thermal expansion bondcoat layer applied to said substrate comprising an alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy thermally sprayed from a powder having a mean particle size of 50 percentile point in distribution of from about 5 microns to about 100 microns, said bondcoat having a surface roughness of at least 200 micro-inches, and said bondcoat having a thermal expansion of about 6.5 millimeters per meter or less between a temperature of from about 25° C. to about 525° C., and (ii) a ceramic insulating layer applied to said bondcoat layer.

Preferred bondcoat layers include those wherein, in the composition of the alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. In one embodiment, the alloy is sprayed from a coarse powder having a mean particle size of 50 percentile point in distribution of from about 30 microns to about 100 microns, preferably a mean particle size of 50 percentile point in distribution of from about 40 microns to about 85 microns, and more preferably a mean particle size of 50 percentile point in distribution of from about 50 microns to about 60 microns. In another embodiment, the alloy is sprayed from a fine powder having a mean particle size of 50 percentile point in distribution of from about 5 microns to about 50 microns, preferably a mean particle size of 50 percentile point in distribution of from about 10 microns to about 40 microns, and more preferably a mean particle size of 50 percentile point in distribution of from about 18 microns to about 25 microns.

The low thermal expansion bondcoat layers preferably have a surface roughness of at least 225 micro-inches, more preferably a surface roughness of at least 250 micro-inches. The bondcoat layers preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C. The bondcoat layers typically have a thickness of from about 4 to about 480 mils, preferably a thickness of from about 80 to about 400 mils, and more preferably a thickness of from about 160 to about 240 mils.

An alpha-Cr phase is present in the bondcoat layers up to a temperature of at least about 1000° C. Preferably, the alpha-Cr phase is present in an amount sufficient to control thermal expansion of the bondcoat layer to about 6.5 mm/m or less between a temperature of from about 25° C. to about 525° C. The bondcoat layers may be heat treated to stabilize their equilibrium phases. An alpha-Cr phase is preferably in equilibrium in thermally stabilized bondcoat layer at a temperature of about 800° C. and the alpha-Cr phase does not dissolve upon heating to a temperature of at least about 1000° C. The bondcoat layers fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoat layers. The oxide dispersion may be selected from alumina, thoria, yttria and rare earth oxides, hafnia and zirconia. The oxide dispersion may comprise from about 5 to about 25 volume percent of the bondcoat layer. Articles can be produced from the thermal barrier coatings above.

Ceramic insulating layers that can be applied to the bondcoat layer to form a thermal barrier coating are known in the art. Illustrative ceramic insulating layers comprise zirconium oxide and yttrium oxide. Preferred ceramic insulating layers include zirconia partially or fully stabilized by yttria and having a density greater than 88% of the theoretical density with a plurality of vertical macrocracks homogeneously dispersed throughout the ceramic insulating layer to improve its thermal fatigue resistance. See, for example, U.S. Pat. No. 5,073,433, the disclosure of which is incorporated herein by reference. Other ceramic insulating layers useful in this invention include zirconia partially or fully stabilized by yttria and having a density from about 60% to 85% of the theoretical density, e.g., low density zirconia partially or fully stabilized by yttria.

Some suitable metal substrates include, for example, nickel base superalloys, nickel base superalloys containing titanium, cobalt base superalloys, and cobalt base superalloys containing titanium. Preferably, the nickel base superalloys would contain more than 50% by weight nickel and the cobalt base superalloys would contain more than 50% by weight cobalt. Illustrative non-metal substrates include, for example, permissible silicon-containing materials.

The low thermal expansion bondcoat layer can be deposited onto a metal or non-metal substrate, and the ceramic insulating layer can be deposited onto the bondcoat layer, using any thermal spray device by conventional methods. Preferred thermal spray methods for depositing the bondcoat layer and ceramic insulating are inert gas shrouded plasma spraying, low pressure or vacuum plasma spraying in chambers, high velocity oxygen-fuel torch spraying, detonation gun coating and the like. The most preferred method is inert gas shrouded plasma spraying. It could also be advantageous to heat treat the bondcoat layer using appropriate times and temperatures to achieve a good bond for the bondcoat layer to the substrate and a high sintered density of the bondcoat layer. Other means of applying a uniform deposit of powder to a substrate in addition to thermal spraying include, for example, electrophoresis, electroplating and slurry deposition.

The above thermal barrier coatings employing low thermal expansion bondcoats and other related subject matter above are disclosed and claimed in copending U.S. patent application Ser. No. 11/703,339, filed on an even date herewith, which is incorporated herein by reference.

As indicated above, this invention relates to a method for minimizing or eliminating interface stress and crack formation in a ceramic insulating layer of a thermal barrier coating, said method comprising (a) applying a low thermal expansion bondcoat layer to a metal or non-metal substrate, said bondcoat layer comprising: (i) an inner layer comprising an inner layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said inner layer alloy, Cr comprises from about 15 to about 45 weight percent of said inner layer alloy, Al comprises from about 5 to about 30 weight percent of said inner layer alloy, and M' comprises from about 0.01 to about 1.0 weight percent of said inner layer alloy, said inner layer alloy thermally sprayed from a powder having a mean particle size of 50 percentile point in distribution of from about 5 microns to about 50 microns; and (ii) an outer layer comprising an outer layer alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said outer layer alloy, Cr comprises from about 15 to about 45 weight percent of said outer layer alloy, Al comprises from about 5 to about 30 weight percent of said outer layer alloy, and M' comprises from about 0.01 to about 1.0 weight percent of said outer layer alloy, said outer layer alloy thermally sprayed from a powder having a mean particle size of 50 percentile point in distribution of from about 30 microns to about 100 microns, and said outer layer having a surface roughness of at least 200 micro-inches; and wherein said bondcoat has a thermal expansion of about 6.5 millimeters per meter or less between a temperature of from about 25° C. to about 525° C., and (b) applying said ceramic insulating layer to said bondcoat layer.

The inner layer alloy and the outer layer alloy may be of the same or different composition.

Preferred inner layer bondcoats include those wherein, in the composition of the inner layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 10 microns to about 40 microns, more preferably a mean particle size of 50 percentile point in distribution of from about 18 microns to about 25 microns.

Preferred outer layer bondcoats include those wherein, in the composition of the outer layer alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. The alloy is preferably sprayed from a powder having a mean particle size of 50 percentile point in distribution of from about 40 microns to about 85 microns, more preferably a mean particle size of 50 percentile point in distribution of from about 50 microns to about 60 microns.

The outer layer bondcoats preferably have a surface roughness of at least 225 micro-inches, more preferably a surface roughness of at least 250 micro-inches. The low thermal expansion bondcoats preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C.

The inner layer bondcoats typically have a thickness of from about 4 to about 320 mils, preferably a thickness of from about 40 to about 240 mils, and more preferably a thickness of from about 80 to about 160 mils. The outer layer bondcoats typically have a thickness of from about 4 to about 480 mils, preferably a thickness of from about 80 to about 400 mils, and more preferably a thickness of from about 160 to about 240 mils.

An alpha-Cr phase is present in the bondcoats of this invention up to a temperature of at least about 1000° C. Preferably, the alpha-Cr phase is present in an amount sufficient to control thermal expansion of the bondcoats to about 6.5 mm/m or less between a temperature of from about 25° C. to about 525° C. The bondcoats of this invention may be heat treated to stabilize their equilibrium phases. An alpha-Cr phase is preferably in equilibrium in thermally stabilized bondcoats of this invention at a temperature of about 800° C. and the alpha-Cr phase does not dissolve upon heating to a temperature of at least about 1000° C. The bondcoats of this invention fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoats of this invention. The oxide dispersion may be selected from alumina, thoria, yttria and rare earth oxides, hafnia and zirconia. The oxide dispersion may comprise from about 5 to about 25 volume percent of the bondcoat composition.

Ceramic insulating layers that can be applied to the bondcoat layer to form a thermal barrier coating are known in the art. Illustrative ceramic insulating layers comprise zirconium oxide and yttrium oxide. Preferred ceramic insulating layers include zirconia partially or fully stabilized by yttria and having a density greater than 88% of the theoretical density with a plurality of vertical macrocracks homogeneously dispersed throughout the ceramic insulating layer to improve its thermal fatigue resistance. See, for example, U.S. Pat. No. 5,073,433, the disclosure of which is incorporated herein by reference. Other ceramic insulating layers useful in this invention include zirconia partially or fully stabilized by yttria and having a density from about 60% to 85% of the theoretical density, e.g., low density zirconia partially or fully stabilized by yttria.

Some suitable metal substrates include, for example, nickel base superalloys, nickel base superalloys containing titanium, cobalt base superalloys, and cobalt base superalloys containing titanium. Preferably, the nickel base superalloys would contain more than 50% by weight nickel and the cobalt base superalloys would contain more than 50% by weight cobalt. Illustrative non-metal substrates include, for example, permissible silicon-containing materials.

The low thermal expansion bondcoat layer can be deposited onto a metal or non-metal substrate, and the ceramic insulating layer can be deposited onto the bondcoat layer, using any thermal spray device by conventional methods. Preferred thermal spray methods for depositing the bondcoat layer and ceramic insulating layer are inert gas shrouded plasma spraying, low pressure or vacuum plasma spraying in chambers, high velocity oxygen-fuel torch spraying, detonation gun coating and the like. The most preferred method is inert gas shrouded plasma spraying. It could also be advantageous to heat treat the bondcoats using appropriate times and temperatures to achieve a good bond for the bondcoats to the substrate and a high sintered density of the bondcoats. Other means of applying a uniform deposit of powder to a substrate in addition to thermal spraying include, for example, electrophoresis, electroplating and slurry deposition.

A method for minimizing or eliminating interface stress and crack formation in a ceramic insulating layer of a thermal barrier coating can comprise (i) applying a low thermal expansion bondcoat layer to a metal or non-metal substrate, said bondcoat layer comprising an alloy of MCrAlM' wherein M is an element selected from nickel, cobalt, iron and mixtures thereof, preferably nickel, and M' is an element selected from yttrium, zirconium, hafnium, ytterbium and mixtures thereof, preferably yttrium, and wherein M comprises from about 35 to about 80 weight percent of said alloy, Cr comprises from about 15 to about 45 weight percent of said alloy, Al comprises from about 5 to about 30 weight percent of said alloy, and M' comprises from about 0.01 to about 1.0 weight percent of said alloy, said alloy thermally sprayed from a powder having a mean particle size of 50 percentile point in distribution of from about 5 microns to about 100 microns, said bondcoat having a surface roughness of at least 200 micro-inches, and wherein said bondcoat layer has a thermal expansion of about 6.5 millimeters per meter or less between a temperature of from about 25° C. to about 525° C., and (ii) applying said ceramic insulating layer to said bondcoat layer.

Preferred bondcoat layers include those wherein, in the composition of the alloy, M comprises from about 40 to about 70 weight percent of said alloy, Cr comprises from about 20 to about 40 weight percent of said alloy, Al comprises from about 10 to about 25 weight percent of said alloy, and M' comprises from about 0.05 to about 0.95 weight percent of said alloy. In one embodiment, the alloy is sprayed from a coarse powder having a mean particle size of 50 percentile point in distribution of from about 30 microns to about 100 microns, preferably a mean particle size of 50 percentile point in distribution of from about 40 microns to about 85 microns, and more preferably a mean particle size of 50 percentile point in distribution of from about 50 microns to about 60 microns. In another embodiment, the alloy is sprayed from a fine powder having a mean particle size of 50 percentile point in distribution of from about 5 microns to about 50 microns, preferably a mean particle size of 50 percentile point in distribution of from about 10 microns to about 40 microns, and more preferably a mean particle size of 50 percentile point in distribution of from about 18 microns to about 25 microns.

The low thermal expansion bondcoat layers preferably have a surface roughness of at least 225 micro-inches, more preferably a surface roughness of at least 250 micro-inches. The bondcoat layers preferably have a thermal expansion of about 6.25 millimeters per meter or less between a temperature of from about 25° C. to about 525° C., more preferably a thermal expansion of about 6.0 millimeters per meter or less between a temperature of from about 25° C. to about 525° C. The bondcoat layers typically have a thickness of from about 4 to about 480 mils, preferably a thickness of from about 80 to about 400 mils, and more preferably a thickness of from about 160 to about 240 mils.

An alpha-Cr phase is present in the bondcoat layers up to a temperature of at least about 1000° C. Preferably, the alpha-Cr phase is present in an amount sufficient to control thermal expansion of the bondcoat layer to about 6.5 mm/m or less between a temperature of from about 25° C. to about 525° C. The bondcoat layers may be heat treated to stabilize their equilibrium phases. An alpha-Cr phase is preferably in equilibrium in thermally stabilized bondcoat layer at a temperature of about 800° C. and the alpha-Cr phase does not dissolve upon heating to a temperature of at least about 1000° C. The bondcoat layers fall within the gamma-beta-alpha-Cr region of a phase diagram, for example, an alpha-Cr+beta-NiAl+gamma (FCC Ni alloy) phase field, at a temperature of about 1150° C.

An oxide dispersion may also be included in the bondcoat layers. The oxide dispersion may be selected from alumina, thoria, yttria and rare earth oxides, hafnia and zirconia. The oxide dispersion may comprise from about 5 to about 25 volume percent of the bondcoat layer.

Ceramic insulating layers that can be applied to the bondcoat layer to form a thermal barrier coating are known in the art. Illustrative ceramic insulating layers comprise zirconium oxide and yttrium oxide. Preferred ceramic insulating layers include zirconia partially or fully stabilized by yttria and having a density greater than 88% of the theoretical density with a plurality of vertical macrocracks homogeneously dispersed throughout the ceramic insulating layer to improve its thermal fatigue resistance. See, for example, U.S. Pat. No. 5,073,433, the disclosure of which is incorporated herein by reference. Other ceramic insulating layers useful in this invention include zirconia partially or fully stabilized by yttria and having a density from about 60% to 85% of the theoretical density, e.g., low density zirconia partially or fully stabilized by yttria.

Some suitable metal substrates include, for example, nickel base superalloys, nickel base superalloys containing titanium, cobalt base superalloys, and cobalt base superalloys containing titanium. Preferably, the nickel base superalloys would contain more than 50% by weight nickel and the cobalt base superalloys would contain more than 50% by weight cobalt. Illustrative non-metal substrates include, for example, permissible silicon-containing materials.

The low thermal expansion bondcoat layer can be deposited onto a metal or non-metal substrate, and the ceramic insulating layer can be deposited onto the bondcoat layer, using any thermal spray device by conventional methods. Preferred thermal spray methods for depositing the bondcoat layer and ceramic insulating are inert gas shrouded plasma spraying, low pressure or vacuum plasma spraying in chambers, high velocity oxygen-fuel torch spraying, detonation gun coating and the like. The most preferred method is inert gas shrouded plasma spraying. It could also be advantageous to heat treat the bondcoat layer using appropriate times and temperatures to achieve a good bond for the bondcoat layer to the substrate and a high sintered density of the bondcoat layer. Other means of applying a uniform deposit of powder to a substrate in addition to thermal spraying include, for example, electrophoresis, electroplating and slurry deposition.

The above method for minimizing or eliminating interface stress and crack formation in a ceramic insulating layer of a thermal barrier coating and other related subject matter above are disclosed and claimed in copending U.S. patent application Ser. No. 11/703,339, filed on an even date herewith, which is incorporated herein by reference.

Various modifications and variations of this invention will be obvious to a worker skilled in the art and it is to be understood that such modifications and variations are to be included within the purview of this application and the spirit and scope of the claims.

The following examples are provided to further describe certain embodiments of the invention. The examples are intended to be illustrative in nature and are not to be construed as limiting the scope of the invention. Table 1 provides a listing of nominal compositions of selected MCrAlY coatings.

TABLE 1

Nominal Compositions of Coatings (Weight Percent)

| Coating | Ni | Co | Cr | Al | Y |
|---|---|---|---|---|---|
| LN-4 | 80 | | 20 | | |
| LN-5B | 95 | | | 5 | |
| LN-11 | 47 | 23 | 17 | 12.5 | 0.5 |
| LN-21 | 48 | 23 | 20 | 8 | 0.5 |
| LN-33 | 69 | | 20 | 11 | 0.5 |
| LN-46 | 53 | 15 | 19 | 12 | 0.5 + 0.5 Mo |
| LN-49 | 53 | 15 | 19 | 13 | 0.5 + 0.5 Mo |
| LCO-7 | | 64 | 24 | 12 | 0.5 |
| LCO-22 | 32 | 38 | 21 | 8 | 0.5 |
| LCO-22 + Al | 29 | 38 | 21 | 11 | 0.5 |
| LCO-29 | | 75 | 18 | 7 | 0.5 |
| LCO-40 | | 63 | 26 | 10 | 0.5 |
| LCO-49 | 42 | 28 | 15 | 14 | 0.5 |
| TM-309 | 42 | 25 | 23 | 10 | 0.5 |
| NiCo electroplate | 57 | 43 | | | |

Example 1

Sample Preparation and Thermal Expansion Measurement Methods

Coatings were made by the plasma spray method using the Praxair Surface Technologies (PST) model 1108 torch with the co-axial inert gas shield protecting the spray effluent. The coatings were deposited onto 12.5 millimeter diameter aluminum tube substrates, about 150 millimeter long to a coating thickness 24-36 mils. The coated tubes were parted to 25 millimeter long cylinders, then most of the aluminum substrate was bored out. The final step was to leach residual aluminum in 25% NaOH at a controlled temperature (less than 38° C.) for about 30 minutes. The NaOH solution does not attack the MCrAlY coating. After leaching, the coating sample was rinsed in de-ionized (DI) water, ultrasonically rinsed in DI water, rinsed in methanol and warm air-dried.

Several cylinders of each coating were vacuum heat treated for 4 hours at 1080° C. One cylinder of each new alloy was analyzed for chemical composition, and at least one was run in this thermally stabilized state in the thermal expansion cycle in a PST sapphire dilatometer. The dilatometer is a vertical push-rod instrument, with three support rods and the length-sensing central rod all cut from the same 600 millimeter long single crystal of sapphire. The sample was loaded, the furnace tube evacuated by a roughing pump then argon backfilled, three times. Then the argon flow was set to 800 cubic millimeters per second ($mm^3/s$) for the test cycle. The sample had a fine-gauge type K thermocouple wired in tight contact to its mid-length. This provided the specimen temperature to the data logger. The furnace control thermocouple is a separate, heavy gauge type K thermocouple. The heating cycle was separately programmed by a dedicated controller. The specimen length change was monitored by a lightly contacting sapphire rod connected to a linear variable differential transformer, which is remote from the hot zone. For the work reported here, the samples were heated at 5° C. per minute to 1100° C. and immediately cooled to room temperature at 5° C. per minute. If any residual sintering occurred, the data was not included in this study, but the sample re-run until it was stable.

The dilatometer was calibrated by running a 25 millimeter long sample of pure Ni, traceable to the National Institute of Standards and Technology. The sample was run multiple times and the average heating and cooling curves were compared to the accepted Ni expansion data published by Thermophysical Property Research Center. See Touloukian, et al., Thermal Expansion, Metallic Elements and Alloys, Thermophysical Properties Research Center—Data Series, 12, Plenum, N.Y., 1976. Any deviation was formed into a correction list which the computer applied to all subsequent samples. All samples reported here were run at least twice, most three to four times. The corrected data for each coating was compared to the average of all runs of that coating at each 100° C. increment of the computer printout. A three-sigma rule for outlier data was tested, but most data was well within bounds and included in the final average expansion curve. The runs usually agreed with each other within 0.3 millimeters per meter at each temperature, though some were more divergent. It was found that the cooling curves usually had lower variance between runs, and so they were chosen to represent the expansion behavior of the coatings.

In this study of a range of MCrAlY compositions, it was found that the expansion from 25 to 525° C. was correlated to the chemical composition of the coating. The multiple correlation fit gave (millimeters per meter):

$$\text{Expansion}(525^\circ\text{ C.})=8.6892-0.01242*\text{Ni}-0.05255*\text{Cr}-0.00104*\text{Al}+0.0002693*\text{Ni}*\text{Co} \quad \text{Equation (1)}$$

where the indicated element is entered into the equation as its weight percent.

The reason why 525° C. was used in this discussion of expansion and mismatch stresses is that the typical MCrAlY coating has high yield stress up to about that temperature, then begins to fall rapidly by about 600° C., and is near zero at about 800° C. or higher. See T. A. Taylor and D. F. Bettridge, Surf. Coat. Technol. 86-87 (1996) 9-14. This means that at high temperature the MCrAlY may not be able to transmit a stress due to expansion mismatch to the zirconia layer because it is so weak or it readily creeps to relaxation.

Research measurements further found that as a class, NiCrAlY compositions had statistically significant lower thermal expansion than the more prevalent CoNiCrAlY or NiCoCrAlY composition classes. The comparison of expansion values for 525° C. for LCO-22, NiCrAlY coating LN-33, and a predicted value for a modified LN-33 (using the multiple correlation equation) were as follows:

| | Thermal Expansion Between 25° C. and 525° C. (millimeters per meter) |
|---|---|
| LCO-22 (32Ni—38Co—21Cr—8Al—0.5Y) | 7.51 |
| LN-33 (69Ni—20Cr—11Al—0.5Y) | 6.79 |
| LN-33 mod (64Ni—23Cr—13Al—0.5Y) | 6.67 |

Based on the logic of lower bondcoat expansion relative to the zirconia layer, it would appear that a composition like that of LN-33 would produce less interface thermal stress than LCO-22, and maybe longer thermal barrier coating cyclic life.

However, the thermal expansion curve of LN-33 was lower than LCO-22 up to about 900° C., then the LN-33 expansion curve swept up significantly such that at 1000° C. and above the expansion was equal to LCO-22 or LN-11 (47Ni-23Co-17Cr-12.5Al-0.5Y). This upsweep has also been measured in a similar composition coating, LN-65 (67Ni-22Cr-10Al-1Y). It is speculated that the LN-33 upsweep was due to the phase transformation:

$$\alpha+\gamma\rightarrow\beta+\gamma,$$

where $\alpha$ is alpha Cr, $\gamma$ is a Ni-base alloy, and $\beta$ is essentially NiAl. All these phases have high thermal expansion except alpha-Cr. Within the composition range of LN-33, alpha-Cr goes into solution and NiAl is formed above about 950° C. See R. L. Dreshfield, T. P. Gabb in Superalloys II, Wiley, New York, 1987, p. 566. The reason the other compositions have the generally higher expansion throughout the temperature range may be that alpha-Cr is either not present or is minimized by the presence of Co.

The above predictive Equation (1) for maintaining low thermal expansion was used in an effort to discover new NiCrAlY compositions that would retain alpha-Cr to high temperature, and thus perhaps eliminate the expansion upsweep as well.

New coatings were plasma sprayed with the PST model 1108 plasma torch, but in a non-shielded mode (air sprayed). One standard NiCrAlY powder (Ni-164) and three experimental alloy powders were made and prepared as coatings. For the three experimental powders, a standard powder lot of Ni-164, made by the vacuum melt argon atomize process (predominate particle size 60-120 microns), was blended with small amounts of pure Cr and Al powders. These elemental powders had predominate particle sizes of 4-8 microns for the Al, 3-14 microns for the Cr, all measured by the Microtrac method. The mixtures of 0.9 kilogram mass were V-blended for 30 minutes. Table 2 shows the calculated compositions of the starting powders and the analyzed composition of the Ni-164 powder. Powder Ni-164 was analyzed by the inductively coupled plasma method. Alloys 3-5 powder compositions were calculated, based on the Ni-164 analysis and the known additions of high purity Al and Cr.

TABLE 2

Composition of Starting Powders (Weight Percent)

| | Ni | Cr | Al | Y |
|---|---|---|---|---|
| Alloy 3 | 61.97 | 27.52 | 9.30 | 0.96 |
| Alloy 4 | 60.71 | 25.35 | 12.75 | 0.94 |
| Alloy 5 | 58.23 | 27.00 | 13.63 | 0.90 |
| Ni-164 | 66.9 | 21.8 | 9.99 | 1.04 |

The chemical analyses of the four heat treated coatings are given in Table 3. It was found that the coating made from the vacuum melted argon atomized powder was very close in composition to the original powder. However, the coatings made from the blends with added Al and Cr changed in composition. The alloy blends lost about 1 to 1.5% Al and gained about 1 to 3% Cr, going from powder to coating. The compositional shift most likely occurred in plasma spraying, but some could have occurred in the vacuum heat treatment. It is important that these analyzed results apply to the cylindrical samples that were run in the thermal expansion cycle, as discussed below. All coatings were plasma sprayed in air without inert gas shrouding and then vacuum heat treated for 4 hours at 1080° C. before chemical analysis. Coating LN-65 was made from Ni-164 powder. Oxygen analyses were by the Leco combustion method.

TABLE 3

Compositions of Heat Treated Coatings (Weight Percent)

| | Ni | Cr | Al | Y | O |
|---|---|---|---|---|---|
| Alloy 3 | 61.5 | 28.45 | 8.53 | 0.83 | 1.11 |
| Alloy 4 | 61.7 | 26.24 | 10.67 | 0.84 | 1.06 |
| Alloy 5 | 56.0 | 30.68 | 12.15 | 0.80 | 1.35 |
| LN-65 | 67.3 | 21.12 | 9.94 | 1.02 | 0.19 |

Expansion Results

Figure 2:
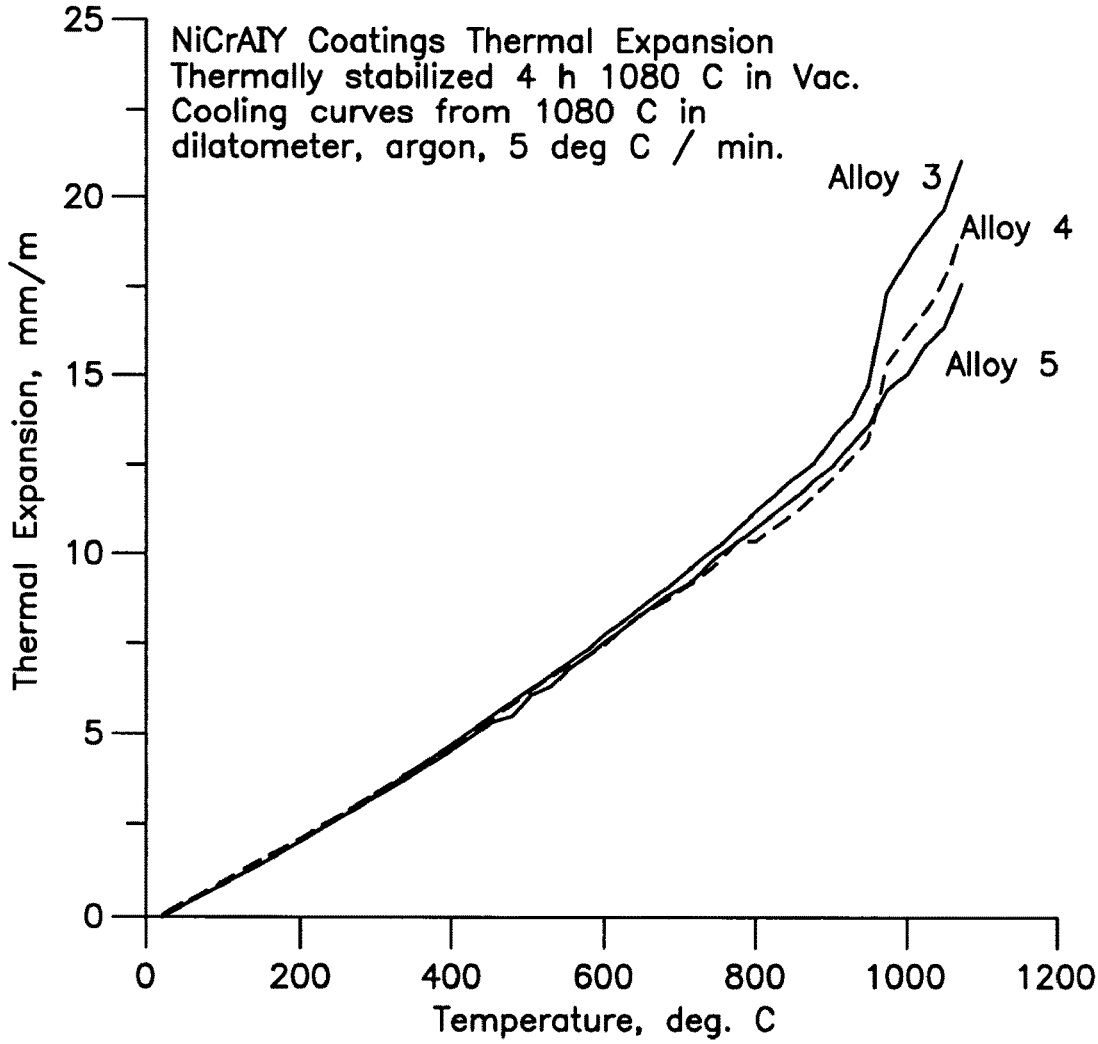
FIG. 2 depicts a graph of thermal expansion from room temperature to 1075° C. for NiCrAlY coatings Alloys 3, 4 and 5 (pre-stabilized 4 hours/1080° C./vacuum. dilatometer, argon, 5° C./min.).

The thermal expansion curves of the thermally-stabilized coatings are shown in FIGS. 1 and 2. It is seen that the LN-65 coating has essentially the same upsweep behavior of the similar composition LN-33 shown earlier. Both the heating and cooling curves are shown in FIG. 1 to demonstrate the hysteresis of the suspected phase transition near 950° C. FIG. 1 also shows that LN-65 was not completely sintered to the final state possible at 1080° C. in 4 hours. An additional 1.5 millimeters per meter (0.15%) shrinkage occurred in this first thermal expansion run after the vacuum heat treatment. Subsequent runs on the same sample do return the cooling curve to the initial specimen length. The three new alloy coatings are shown in FIG. 2, but only the cooling curve for clarity. Alloys 3 and 4 show the upsweep at about 950° C. but it is not as sharp and there is less expansion at the highest temperature of the thermal expansion run. There are similar hysteresis effects for alloys 3 and 4 as seen in LN-65. Alloy 5 appears to have essentially eliminated the upsweep, but there is still a slight effect at 950° C., which is reproducible for repeat thermal expansion runs of this alloy.

The expansion curves gave the following values at 525° C. on cooling, and are compared to the predicted values using Equation (1) above. Three separate tests were done for the experimental data reported. The chemical analyses of the heat treated coatings of Table 3 were used in the calculation. The oxygen in the analysis was taken to be combined with yttrium first, then aluminum due to the stabilizing heat treatment at 1080° C., and only the residual metallic aluminum was used in the calculation.

Thermal expansion between 25° C. and 525° C. (cooling) [mm/m]

| Experimental | Avg. | Std. Dev. | Calculated Eqn. (1) |
|---|---|---|---|
| Alloy 3 | 6.50 | 0.12 | 6.36 |
| Alloy 4 | 6.74 | 0.13 | 6.48 |
| Alloy 5 | 6.42 | 0.13 | 6.31 |
| LN-65 | 7.04 | 0.11 | 6.70 |

The predictive Equation (1) above does well with the three new alloys, but the experimental data for LN-65 is higher than predicted. LN-65 is a composition not much different than LN-33, whose expansion data agreed very well with Equation (1).

Sintering Results

The vacuum sintering was done in a Lindberg furnace. The procedure was to stand the coating cylinders on trays, pump down to 90 microns pressure, back-fill with argon to 900 microns and re-pump, repeating three times, then engage the high vacuum pumps to reach a vacuum of about $10^{-3}$ mm Hg before heating. Heating was at 25° C. per minute to 300° C. for a one hour outgas hold then to 1080° C., holding for four hours, then cooling to room temperature at initially 35° C. per minute. During the 1080° C. soak, chamber pressure was at $5\times10^{-5}$ mm Hg.

The cylindrical samples were measured before and after the vacuum heat treatment for weight, length and average diameter. The changes in these values relative to the as-coated sample are given in Table 4. In addition, each cylinder was measured for true density by the water immersion method (ASTM B-328-72), except that the oil-sealing step was omitted, in case the samples would be run again in the dilatometer. Separate as-coated cylinders were also measured for density, including the oil impregnation step. These density changes are also given in Table 4. All changes are decreases except density increases. Density increase values for vacuum also include one dilatometer thermal expansion cycle, room temperature to 1080° C. and return at 5° C. per minute. Effect of this extra cycle was found to increase density by 0.1 to 0.6 percent over vacuum heat treating only.

TABLE 4

Coating Changes Due to 4 Hours at 1080° C.

| | | Percent change from as-coated | | | |
|---|---|---|---|---|---|
| | | Weight | Length | Diameter | Density |
| In vacuum furnace | Alloy 3 | 0.60, 0.53 | 1.02, 1.02 | 1.08, 0.90 | 8.7 |
| | Alloy 4 | 0.56 | 1.31 | 1.05 | 12.8 |
| | Alloy 5 | 0.47, 0.48 | 0.78, 0.69 | 0.62, 0.89 | 11.3 |
| | LN-65 | 0.31 | 1.80 | 1.96 | 13.5 |
| In argon dilatometer | Alloy 3 | 0.41 | 0.95 | 0.80 | — |
| | Alloy 5 | 0.34 | 1.10 | 0.90 | 10.8 |
| | LN-65 | 0.16 | 2.02 | 1.95 | 13.6 |

Figure 3:
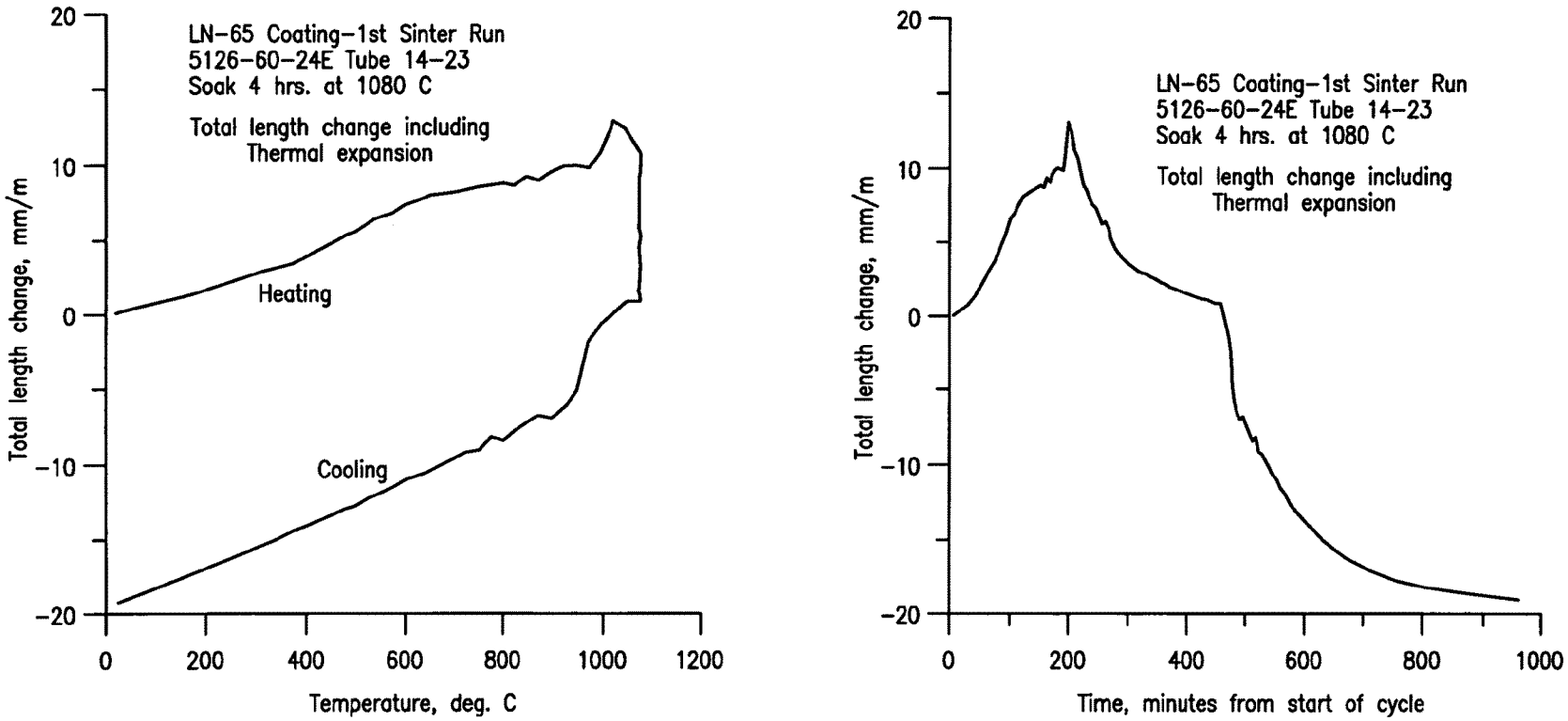
FIG. 3 depicts a graph of sintering cycle curves for coating Alloy 3 from room temperature to 1080° C., 4 hour soak at 1080° C., then cooling to room temperature; heating and cooling rates of 5° C. per minute, argon atmosphere; and length change includes thermal expansion, sintering and any phase change effects.
Figure 4:
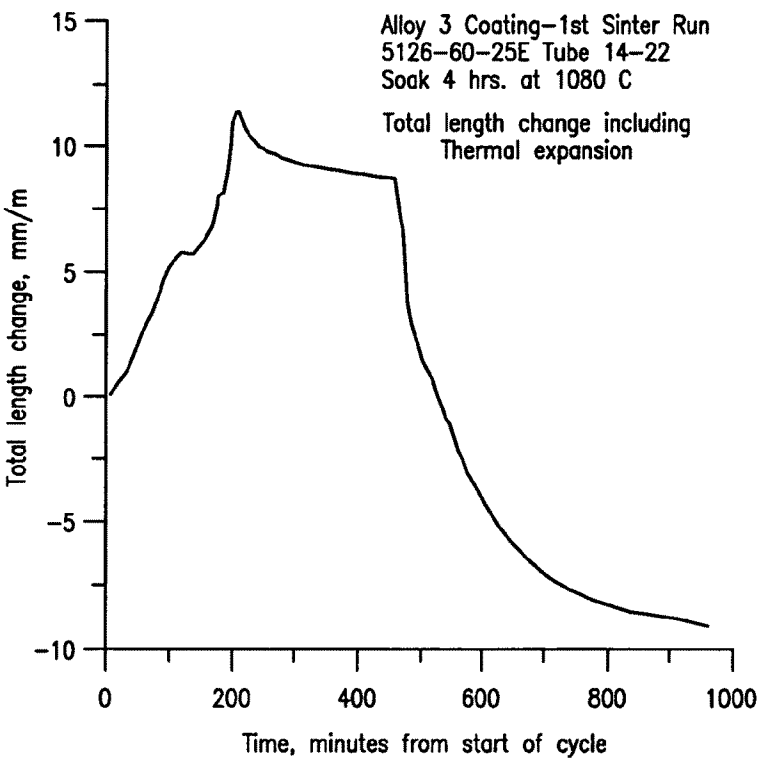
FIG. 4 depicts a graph of sintering cycle curves for coating LN-65 from room temperature to 1080° C., 4 hour soak at 1080° C., then cooling to room temperature; heating and cooling rates of 5° C. per minute, argon atmosphere; and length change includes thermal expansion, sintering and any phase change effects.
Figure 4:
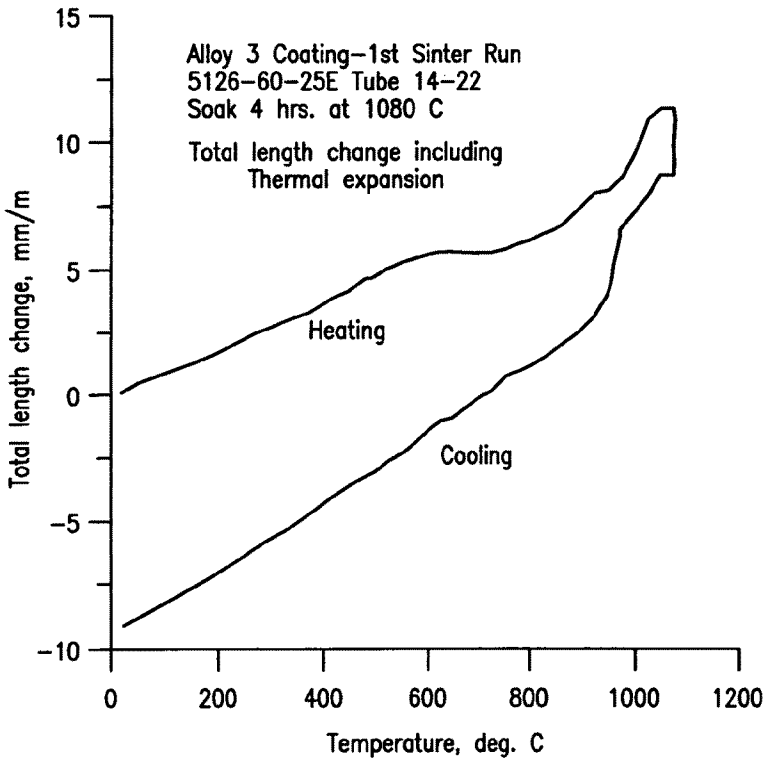
Figure 5:
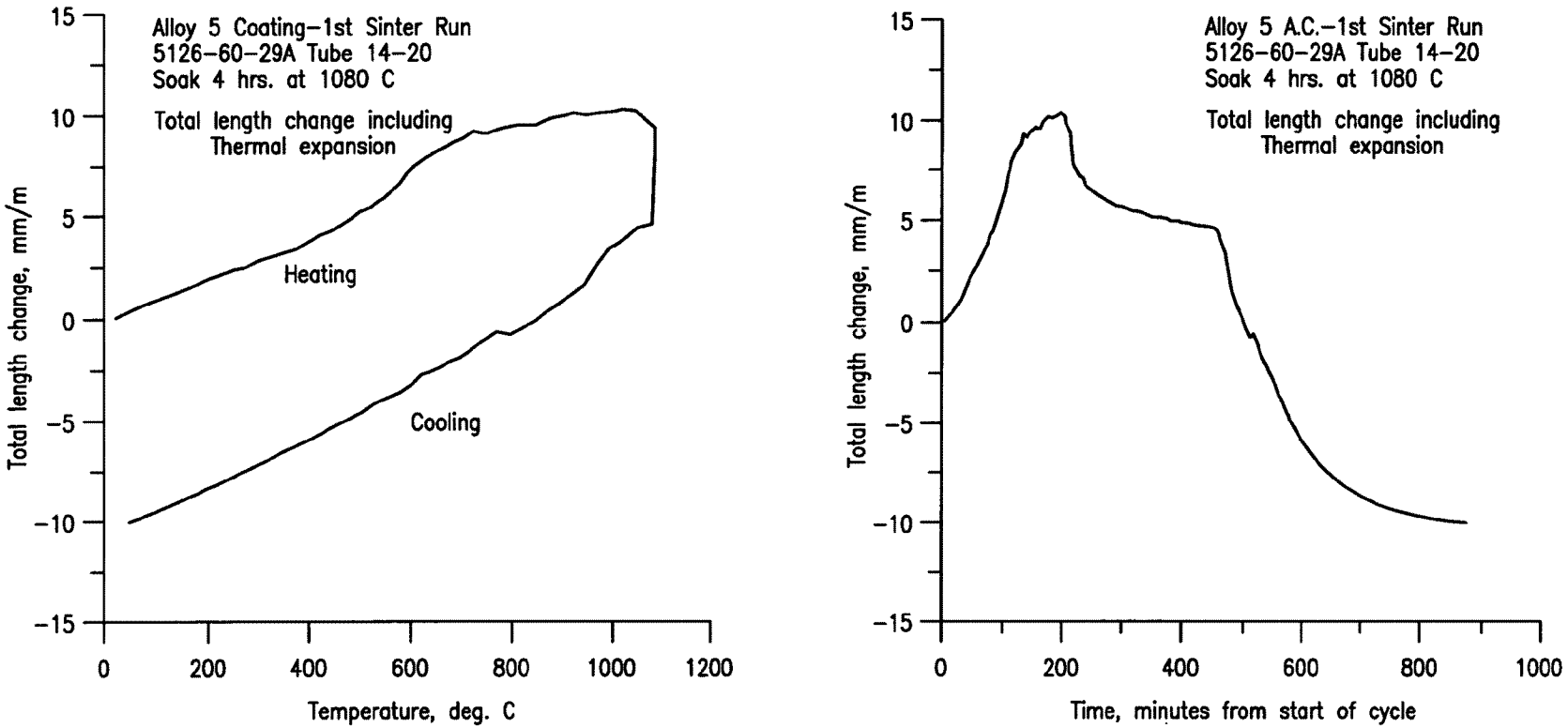
FIG. 5 depicts a graph of sintering cycle curves for coating Alloy 5 from room temperature to 1080° C., 4 hour soak at 1080° C., then cooling to room temperature; heating and cooling rates of 5° C. per minute, argon atmosphere; and length change includes thermal expansion, sintering and any phase change effects.

The dilatometer curves for the sintering cycle are shown in FIGS. 3, 4 and 5 for LN-65 and Alloy 3 and 5 coatings. The length shrinkage from the dilatometer data and by separate micrometer measurements were in close agreement. The percent diameter shrinkage measured by vernier micrometer was very close to the length shrinkage. The third dimension, coating thickness, was too small to measure accurately for shrinkage. Assuming thickness shrinkage was an equal percentage, a volume shrinkage estimate for the coatings by taking three times the length shrinkage.

Estimated Percent Volume Shrinkage for 4 Hours/1080° C. Cycles

| | Vacuum Furnace | Dilatometer |
|---|---|---|
| Alloy 3 | 3.0 | 2.8 |
| Alloy 4 | 3.9 | — |
| Alloy 5 | 2.2 | 3.3 |
| LN-65 | 5.4 | 6.0 |

These results and those of Table 4 show that dilatometry agrees well with vacuum furnace heat treatment, for final state sintering results.

The dilatometer data is now examined for the dynamic changes that occur during the thermal cycle. The length change plots of FIGS. 3, 4 and 5 show the data both as a function of time and temperature. The curves include sintering, thermal expansion, phase development and phase transition. These curves suggest some sintering length contraction occurs before the sample reaches 1080° C., perhaps starting as low as 800° C. Significant shrinkage further occurs during the 4 hour hold at 1080° C. Finally the last segments of the curves show the cool-down to room temperature.

LN-65 coating started from pre-alloyed powder so only solid state sintering occurred. Alloys 3 and 5 started from powder blends, and some of the sintering is likely due to aluminum liquid phase assisted sintering, as suggested by the shrinkage noted near 660° C., perhaps seen more clearly for Alloy 3. The phase transition is apparent in these curves also, the sharp run-up near 1000° C. (heating) for LN-65 and Alloy 3, but absent in Alloy 5. On cooling, the rapid length drop near 950° C. is again seen in LN-65 and Alloy 3. The phase transition can also be seen in the time plots of LN-65 and Alloy 3, just before entering the 4 hour soak period.

Coating Phase Analysis

The polished microstructures of select coatings were examined in the optical and scanning electron microscopes. The coatings selected were Alloy 3 and Alloy 5. In each case, separate cylinder samples were first vacuum heat treated 4 hours at 1080° C. Then segments of the cylinders were stabilized at 800° C. and at 1050° C. (below and above the suspected phase transition). The stabilization time was one hour in flowing argon, followed by a rapid quench into stirred ice water. The dilatometer trace (FIG. 1) for LN-65 shows that this stabilization time should have been more than adequate.

The coatings were metallographically polished then electrolytically etched with 1 part sulfuric acid in 7 parts methanol for 1 second at 12 volts DC. The examination was done first optically with bright field and DIC at 1500 times magnification, then the identity of the alpha-Cr phase in Alloy 5 was checked in the scanning electron microscope/energy dispersive spectroscope.

The phases present in the three coatings were as follows:

| | 800° C. | 1050° C. |
|---|---|---|
| Alloy 3 | γ, γ', α-Cr | γ, β-NiAl |
| Alloy 5 | γ, γ', β-NiAl, α-Cr | α-Cr, β, γ |

In the above samples alpha-Cr was a minor phase in Alloy 3 at 800° C., but present. In Alloy 5, alpha-Cr was a major phase at both temperatures of stabilization. The effects of using blended powders was also seen, the phase distribution was not uniform everywhere, which would be expected to be found in the next phase using pre-alloyed powders.

Figure 6:
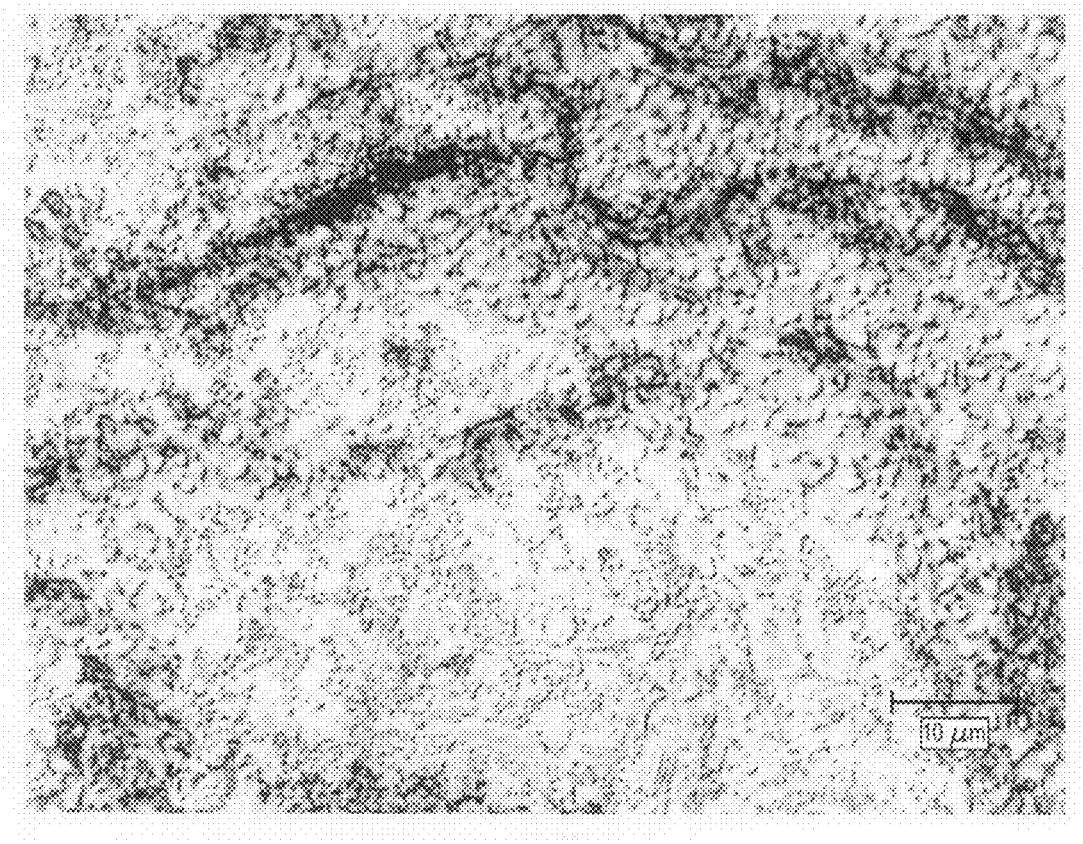
FIG. 6 depicts an optical micrograph (DIC) of polished and etched cross section of Alloy 5 coating, heat treated 4 hours at 1080° C. in vacuum, then held 1 hour at 800° C. and quenched to ice water. Visible phases include oxide bands, alpha-Cr, NiAl-type, gamma Ni—Cr—Al and gamma-prime colonies ($Ni_3Al$-type).
Figure 7:
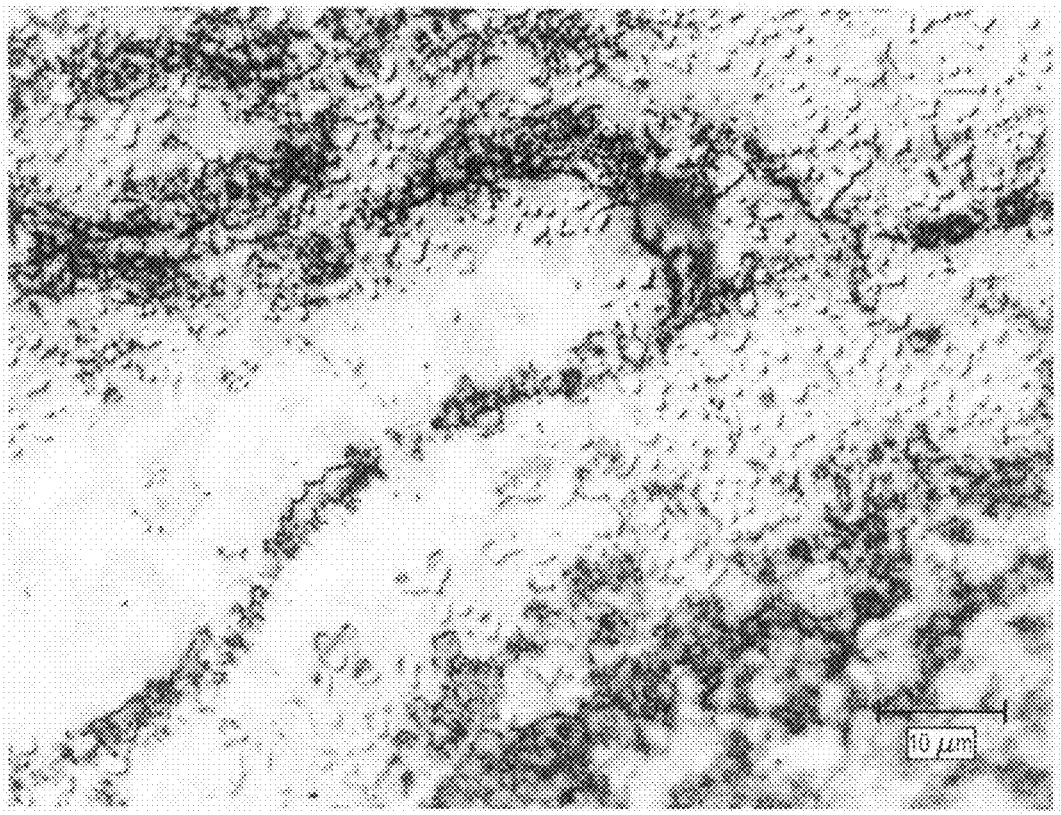
FIG. 7 depicts an optical micrograph (DIC) of polished and etched cross section of Alloy 5 coating, heat treated 4 hours at 1080° C. in vacuum, then held 1 hour at 1050° C. and quenched to ice water. Visible phases include oxide bands, alpha-Cr, NiAl-type and gamma Ni—Cr—Al.
Figure 8:
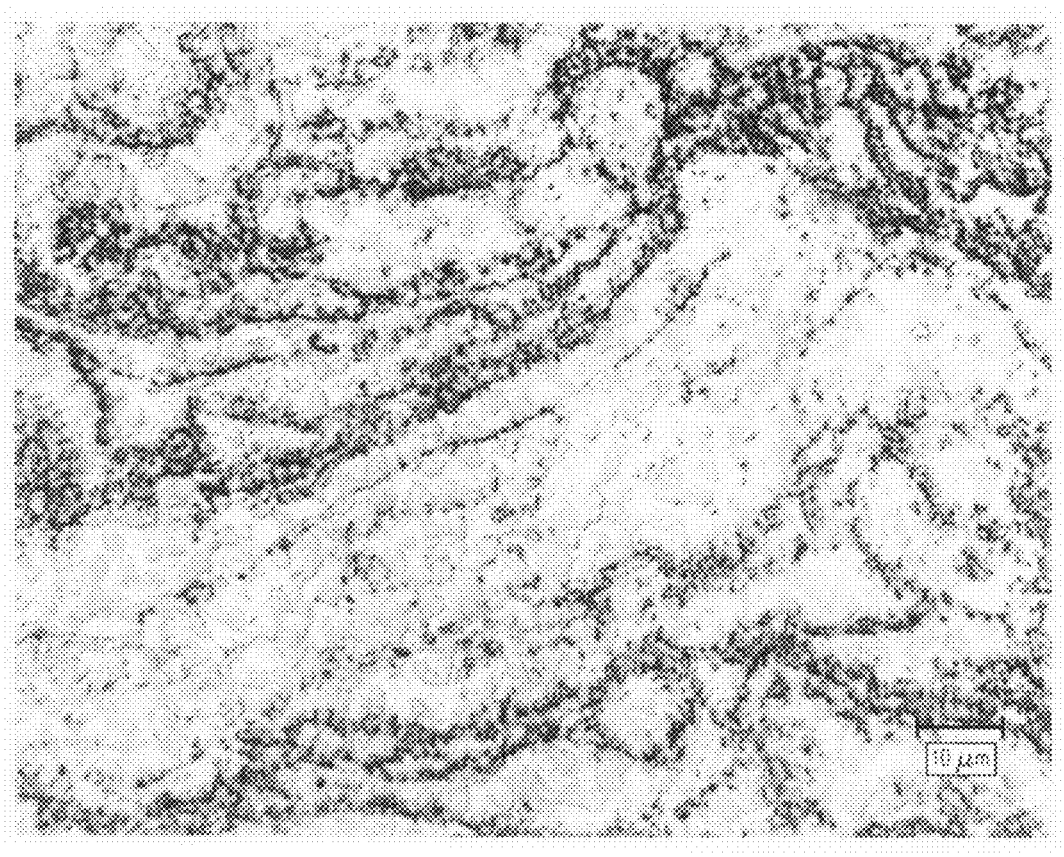
FIG. 8 depicts an optical micrograph (DIC) of polished and etched cross section of Alloy 3 coating, heat treated 4 hours at 1080° C. in vacuum, then held 1 hour at 1050° C. and quenched to ice water. Visible phases include oxide bands, NiAl-type and gamma Ni—Cr—Al.

In FIGS. 6, 7 and 8, optical micrographs of the etched microstructure of Alloy 5, at 800° C. and 1050° C. stabilization, and for Alloy 3 at 1050° C. stabilization. It is seen that alpha-Cr is not present in Alloy 3 at the higher temperature. The phase size was estimated from these figures. When present, the phases were essentially the same size in both alloys. The alpha-Cr phase was about 0.8-1.7 microns, of rounded cubical morphology. The beta NiAl was about 2-4 microns in size. The gamma prime, $Ni_3Al$-type phase was very fine, about 0.25-0.5 microns, and arranged in colonies, very similar to that in superalloys. See E. W. Ross and C. T. Sims in Superalloys II, Wiley, New York, 1987, p. 124.

In development of new NiCrAlY composition coatings, looking for means to reduce the thermal expansion of the alloy and to avoid the typical NiCrAlY upsweep in thermal expansion at 950° C., several results were obtained. While it proved expeditious to use pure Cr and Al additions to a pre-alloyed NiCrAlY stock powder, there were certain undesirable effects. The chemical composition did shift somewhat from the blended composition to the final coating. Mainly aluminum was lost, but chromium gained. Alloy 5 still retained enough additional Cr and Al to test the theory that a composition retaining alpha-Cr to high temperature was needed to eliminate the expansion upsweep found in LN-65 and LN-33. Air-spray deposition did oxidize the coatings somewhat, but with the minimal aluminum lost to form alumina, the residual metallic composition still formed the desired phases in Alloy 5.

The phase analysis of the coatings proved the usefulness of differential interference contrast to image the gamma-prime phase ($Ni_3$ μl), which was not seen in bright field. The phases found in Alloys 3 and 5 are different from those indicated for LN-33, including, in addition, gamma-prime. This is because the new compositions are richer in Cr and Al and have clearly moved to a new equilibrium phase field.

The dilatometer has proven to be very useful in this study of dynamic phase transitions and of sintering. It also gave the direct measure of the lower thermal expansion values for Alloy 5, which would lead to less thermal mismatch stress at a zirconia interface with such a new bondcoat. Similar to the opening comparison of expansion differences between LCO-22 and 7% yttria stabilized zirconia, the new Alloy 5 has the following expansion comparison, from 25° C. to 525° C. (millimeters per meter):

| Alloy 5 | ZrO2—7% Y2O3 | Difference (%) |
|---|---|---|
| 6.42 | 5.3 | 21 |

Thus the expansion mismatch at 525° C. was reduced by half, compared to a current standard composition bondcoat.

When pre-alloyed powder and shrouded plasma are used, both the chemical shifts and oxide formation found in these examples should be eliminated. Thermal cycle testing of these thermal barrier coating systems based on the new bondcoat composition, in comparison to earlier NiCoCrAlY bondcoats, should show longer life for the thermal barrier coating system using the newly discovered bondcoat alloys.

The plasma spray torch in air atmosphere is not the only method of coating fabrication that could use the new alloys. Plasma spraying with a coaxial inert gas shroud, plasma spraying in a vacuum chamber, high velocity oxy-fuel spraying, detonation gun spraying and laser cladding are all coating methods applicable to making the new coatings.

The comparative thermal expansion data for the yttria-stabilized zirconia coatings were also made by the plasma spray process. However, the new alloys can also be overcoated by oxide ceramics made by other processes, such as electron beam physical vapor deposition, liquid solution-based plasma deposition, high velocity oxy-fuel deposition, and detonation gun deposition, among others. The benefits of the new low expansion bondcoat will be found independent of the deposition method of the zirconia-based ceramic top layer.

In addition to new low expansion coating alloys of this invention, solid articles may also be fabricated that could benefit from low expansion. As in the example above, consider the comparison of thermal expansion from 25° C. to 525° C. of a typical superalloy and Alloy 5 (millimeters per meter).

| Typical Ni Superalloy | Alloy 5 |
|---|---|
| 7.4 | 6.42 |

The new NiCrAlY Alloy 5 was thus found to have lower thermal expansion than even a typical Ni-based superalloy. There are likely many applications where a cast or wrought alloy having lower thermal expansion would allow an article to have superior performance. An article of composition based on Alloy 5 or near compositions, should have excellent high temperature oxidation resistance, better than most typical Ni-based superalloys or stainless steels, due to the high Cr and Al content of these new NiCrAlY alloys.

Powder particle size distribution is measured by the light scattering method with the powder sample suspended in a liquid solution (ASTM B 822-97) using a Microtrac model X-100 instrument (Leeds & Northrup, St. Petersburg, Fla.) operated in the X-100 mode.

Coating surface roughness is measured by the contact stylus method (ASTM D 7127-05) using a Taylor Hobson model Surtronic 3P (Leicester, England) in the Ra mode.

While it has been shown and described what is considered to be certain embodiments of the invention, it will, of course, be understood that various modifications and changes in form or detail can readily be made without departing from the spirit and scope of the invention. It is, therefore, intended that this invention not be limited to the exact form and detail herein shown and described, nor to anything less than the whole of the invention herein disclosed and hereinafter claimed.

The invention claimed is:

1. A low thermal expansion bondcoat for thermal barrier coatings, said bondcoat comprising:

(i) an inner layer comprising an inner layer alloy of MCrAlM' wherein M is an element selected from nickel, cobalt, iron and mixtures thereof, and M' is an element selected from yttrium, zirconium, hafnium, ytterbium and mixtures thereof, and wherein said inner layer has a composition based on the thermal expansion of said inner layer that is determined by the equation:

$$\text{Thermal Expansion(6.5 millimeters per meter or less between 25° C. to 525° C.)} = 8.6892 - 0.01242*Ni - 0.05255*Cr - 0.00104*Al + 0.0002693*Ni*Co$$

in which the indicated element is its weight percent based on the total weight of said inner layer; said inner layer alloy thermally sprayed from a powder having a mean particle size of 50 percentile point in distribution of from about 5 microns to about 50 microns; and (ii) an outer layer comprising an outer layer alloy of MCrAlM' wherein M is an element selected from nickel, cobalt, iron and mixtures thereof, and M' is an element selected from yttrium, zirconium, hafnium, ytterbium and mixtures thereof, and wherein said outer layer has a composition based on the thermal expansion of said outer layer that is determined by the equation:

Thermal Expansion(6.5 millimeters per meter or less between 25° C. to 525° C.)=8.6892−0.01242*Ni−0.05255*Cr−0.00104*Al+0.0002693*Ni*Co in which the indicated element is its weight percent based on the total weight of said outer layer; said outer layer alloy thermally sprayed from a powder having a mean particle size of 50 percentile point in distribution of from about 30 microns to about 100 microns, and said outer layer having a surface roughness of at least 200 micro-inches;

wherein said bondcoat has a thermal expansion of about 6.5 millimeters per meter or less between a temperature of from about 25° C. to about 525° C.; wherein an alpha-Cr phase is present in said inner layer and said outer layer in an amount sufficient to control thermal expansion of said bondcoat to about 6.5 millimeters per meter or less between a temperature of from about 25° C. to about 525° C.; and wherein the bondcoat is heat treated to stabilize equilibrium phases of said bondcoat, and the alpha-Cr phase is in equilibrium in said bondcoat composition that has been thermally stabilized at a temperature of about 800° C. and said alpha-Cr phase does not dissolve upon heating to a temperature of at least about 1000° C.

2. The low thermal expansion bondcoat of claim 1 wherein M is nickel and M' is yttrium in the inner layer alloy and M is nickel and M' is yttrium in the outer layer alloy.

3. The low thermal expansion bondcoat of claim 1 wherein said inner layer alloy and said outer layer alloy are the same or different composition.

4. The low thermal expansion bondcoat of claim 1 wherein said inner layer alloy is thermally sprayed from a powder having a mean particle size of 50 percentile point in distribution of from about 10 microns to about 40 microns and said outer layer alloy is thermally sprayed from a powder having a mean particle size of 50 percentile point in distribution of from about 40 microns to about 85 microns.

5. The low thermal expansion bondcoat of claim 1 wherein said inner layer has a thickness of from about 4 to about 320 mils and said outer layer has a thickness of from about 4 to about 480 mils.

6. The low thermal expansion bondcoat of claim 1 wherein said outer layer has a surface roughness of at least 225 micro-inches.

7. The low thermal expansion bondcoat of claim 1 wherein

M comprises from about 40 to about 70 weight percent of said alloy,

Cr comprises from about 20 to about 40 weight percent of said alloy,

Al comprises from about 10 to about 25 weight percent of said alloy, and

M' comprises from about 0.05 to about 0.95 weight percent of said alloy.

8. The low thermal expansion bondcoat of claim 1 wherein an alpha-Cr phase is present up to a temperature of at least about 1000° C.

9. The low thermal expansion bondcoat of claim 1 that falls within an alpha-Cr+beta-NiAl+gamma (FCC Ni alloy) phase field at a temperature of about 1150° C.

10. The low thermal expansion bondcoat of claim 1 further comprising an oxide dispersion.

11. The low thermal expansion bondcoat of claim 10 wherein the oxide dispersion is selected from alumina, thoria, yttria and rare earth oxides, hafnia and zirconia.

12. The low thermal expansion bondcoat of claim 10 wherein the oxide dispersion comprises from about 5 to about 25 volume percent of said coating composition.

13. A metal or non-metal substrate coated with the low thermal expansion bondcoat of claim 1.

14. A thermal barrier coating for a metal or non-metal substrate comprising (a) a low thermal expansion bondcoat layer applied to said substrate, said bondcoat layer comprising:

(i) an inner layer comprising an inner layer alloy of MCrAlM' wherein M is an element selected from nickel, cobalt, iron and mixtures thereof, and M' is an element selected from yttrium, zirconium, hafnium, ytterbium and mixtures thereof, and wherein said inner layer has a composition based on the thermal expansion of said inner layer that is determined by the equation:

Thermal Expansion(6.5 millimeters per meter or less between 25° C. to 525° C.)=8.6892−0.01242*Ni−0.05255*Cr−0.00104*Al+0.0002693*Ni*Co in which the indicated element is its weight percent based on the total weight of said inner layer; said inner layer alloy thermally sprayed from a powder having a mean particle size of 50 percentile point in distribution of from about 5 microns to about 50 microns; and (ii) an outer layer comprising an outer layer alloy of MCrAlM' wherein M is an element selected from nickel, cobalt, iron and mixtures thereof, and M' is an element selected from yttrium, zirconium, hafnium, ytterbium and mixtures thereof, and wherein said outer layer has a composition based on the thermal expansion of said outer layer that is determined by the equation:

Thermal Expansion(6.5 millimeters per meter or less between 25° C. to 525° C.)=8.6892−0.01242*Ni−0.05255*Cr−0.00104*Al+0.0002693*Ni*Co in which the indicated element is its weight percent based on the total weight of said outer layer; said outer layer alloy thermally sprayed from a powder having a mean particle size of 50 percentile point in distribution of from about 30 microns to about 100 microns, and said outer layer having a surface roughness of at least 200 micro-inches; and wherein said bondcoat has a thermal expansion of about 6.5 millimeters per meter or less between a temperature of from about 25° C. to about 525° C.: wherein an alpha-Cr phase is present in said inner layer and said outer layer in an amount sufficient to control thermal expansion of said bondcoat to about 6.5 millimeters per meter or less between a temperature of from about 25° C. to about 525° C.; and wherein the bondcoat is heat treated to stabilize equilibrium phases of said bondcoat, and the alpha-Cr phase is in equilibrium in said bondcoat composition that has been thermally stabilized at a temperature of about 800° C. and said alpha-Cr phase does not dissolve upon heating to a temperature of at least about 1000° C.; and (b) a ceramic insulating layer applied to said bondcoat layer.

15. The thermal barrier coating of claim 14 wherein M is nickel and M' is yttrium in the inner layer alloy and M is nickel and M' is yttrium in the outer layer alloy.

16. The thermal barrier coating of claim 14 wherein said inner layer alloy and said outer layer alloy are the same or different composition.

17. The thermal barrier coating of claim 14 wherein said inner layer alloy is thermally sprayed from a powder having a mean particle size of 50 percentile point in distribution of from about 10 microns to about 40 microns and said outer layer alloy is thermally sprayed from a powder having a mean particle size of 50 percentile point in distribution of from about 40 microns to about 85 microns.

18. The thermal barrier coating of claim 14 wherein said inner layer has a thickness of from about 4 to about 320 mils and said outer layer has a thickness of from about 4 to about 480 mils.

19. The thermal barrier coating of claim 14 wherein said outer layer has a surface roughness of at least 225 micro-inches.

20. The thermal barrier coating of claim 14 wherein

M comprises from about 40 to about 70 weight percent of said alloy,

Cr comprises from about 20 to about 40 weight percent of said alloy,

Al comprises from about 10 to about 25 weight percent of said alloy, and

M' comprises from about 0.05 to about 0.95 weight percent of said alloy.

21. The thermal barrier coating of claim 14 wherein an alpha-Cr phase is present in said bondcoat layer up to a temperature of at least about 1000° C.

22. The thermal barrier coating of claim 14 wherein the bondcoat falls within an alpha-Cr+beta-NiAl+gamma (FCC Ni alloy) phase field at a temperature of about 1150° C.

23. The thermal barrier coating of claim 14 where the ceramic insulating layer comprises zirconium oxide and yttrium oxide.

24. A metal or non-metal substrate coated with the thermal barrier coating of claim 14.

25. A metal or non-metal substrate coated with a thermal barrier coating by a method, said method comprising (a) applying a low thermal expansion bondcoat layer to a metal or non-metal substrate, said bondcoat layer comprising:

(i) an inner layer comprising an inner layer alloy of MCrAlM' wherein M is an element selected from nickel, cobalt, iron and mixtures thereof, and M' is an element selected from yttrium, zirconium, hafnium, ytterbium and mixtures thereof, said inner layer has a composition based on the thermal expansion of said inner layer that is determined by the equation:

$$\text{Thermal Expansion(6.5 millimeters per meter or less between 25° C. to 525° C.)} = 8.6892 - 0.01242*Ni - 0.05255*Cr - 0.00104*Al + 0.0002693*Ni*Co$$

in which the indicated element is its weight percent based on the total weight of said inner layer; said inner layer alloy thermally sprayed from a powder having a mean particle size of 50 percentile point in distribution of from about 5 microns to about 50 microns; and (ii) an outer layer comprising an outer layer alloy of MCrAlM' wherein M is an element selected from nickel, cobalt, iron and mixtures thereof, and M' is an element selected from yttrium, zirconium, hafnium, ytterbium and mixtures thereof, said outer layer has a composition based on the thermal expansion of said outer layer that is determined by the equation:

$$\text{Thermal Expansion(6.5 millimeters per meter or less between 25° C. to 525° C.)} = 8.6892 - 0.01242*Ni - 0.05255*Cr - 0.00104*Al + 0.0002693*Ni*Co$$

in which the indicated element is its weight percent based on the total weight of said outer layer; said outer layer alloy thermally sprayed from a powder having a mean particle size of 50 percentile point in distribution of from about 5 microns to about 100 microns, and said outer layer having a surface roughness of at least 200 micro-inches; and wherein said bondcoat has a thermal expansion of about 6.5 millimeters per meter or less between a temperature of from about 25° C. to about 525° C.; wherein an alpha-Cr phase is present in said inner layer and said outer layer in an amount sufficient to control thermal expansion of said bondcoat to about 6.5 millimeters per meter or less between a temperature of from about 25° C. to about 525° C.; and wherein the bondcoat is heat treated to stabilize equilibrium phases of said bondcoat, and the alpha-Cr phase is in equilibrium in said bondcoat composition that has been thermally stabilized at a temperature of about 800° C. and said alpha-Cr phase does not dissolve upon heating to a temperature of at least about 1000° C.; and (b) applying a ceramic insulating layer to said bondcoat layer.

* * * * *